US007717537B2

(12) United States Patent
Takatsuka

(10) Patent No.: US 7,717,537 B2
(45) Date of Patent: May 18, 2010

(54) LIQUID EJECTION APPARATUS AND LIQUID MAINTENANCE METHOD

(75) Inventor: Tsutomu Takatsuka, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 751 days.

(21) Appl. No.: 11/542,208

(22) Filed: Oct. 4, 2006

(65) Prior Publication Data

US 2007/0091139 A1 Apr. 26, 2007

(30) Foreign Application Priority Data

Oct. 5, 2005 (JP) ..... 2005-292652

(51) Int. Cl.
*B41J 2/165* (2006.01)

(52) U.S. Cl. ..... 347/29; 347/32

(58) Field of Classification Search ..... 347/29, 347/30, 32, 23

See application file for complete search history.

(56) References Cited

U.S. PATENT DOCUMENTS 6,305,778 B1 * 10/2001 Kobayashi et al. ..... 347/30
6,543,876 B2 * 4/2003 Kotaki ..... 347/30

FOREIGN PATENT DOCUMENTS

JP 2003-72104 A 3/2003
JP 2004-167698 A 6/2004
JP 2004-216809 A 8/2004

* cited by examiner

*Primary Examiner*—Shih-wen Hsieh
(74) *Attorney, Agent, or Firm*—Birch, Stewart, Kolasch & Birch, LLP

(57) ABSTRACT

The liquid ejection apparatus comprises: a liquid ejection head which has nozzles ejecting liquid in a downward-facing state and pressure chambers connected to the nozzles; a turning device which turns the liquid ejection head to switch the nozzles of the liquid ejection head between the downward-facing state and an upward-facing state; and a sealing device which seals the nozzles when the nozzles of the liquid ejection head are in the upward-facing state.

9 Claims, 16 Drawing Sheets

LIQUID EJECTION APPARATUS AND LIQUID MAINTENANCE METHOD

BACKGROUND OF THE INVENTION

1. Field of the Invention

The present invention relates to a liquid ejection apparatus and a liquid maintenance method, and more particularly, to a liquid ejection apparatus which ejects liquid toward a prescribed medium and a liquid maintenance method which maintains the state of the liquid.

2. Description of the Related Art

There is a liquid ejection apparatus which ejects dispersion liquid in which dispersed micro-particles are suspended. Examples of material of the micro-particles include, for instance, pigment, high-polymer resin, metal, glass, or oxide or compound of these. Generally, the micro-particles tend to aggregate and settle with the passage of time. When the liquid in which the micro-particles have aggregated and settled is ejected, then there is deterioration of quality in the ejection results, namely, density non-uniformities or distortions, poor color reproduction, non-uniform density of the micro-particles, and the like. Therefore, technology for maintaining the state of the dispersion liquid has been proposed.

For example, Japanese Patent Application Publication No. 2004-167698 discloses a liquid ejection apparatus in which a liquid ejection head having a projection on the bottom is supported on a carriage, which moves reciprocally in a main scanning direction, and a cam is provided to press the projection of the liquid ejection head to move the liquid ejection head in a substantially perpendicular direction (a vertical direction) with respect to the carriage so that the liquid ejection head to perform a swinging motion in the substantially perpendicular direction (the vertical direction) and the liquid inside a liquid chamber (ink cartridge) held on the liquid ejection head is agitated in such a manner that a settled state of the contents in the liquid is eliminated.

Japanese Patent Application Publication No. 2004-216809 discloses technology in which, when nozzles of an inkjet head oppose a recording medium (i.e., in a printing state), a free surface of the ink (the liquid-atmosphere interface, which is also commonly called "meniscus") in the nozzle that is not to eject the ink is caused to vibrate to an extent in which the ink is not ejected, while the ink is ejected and discarded through the nozzles when not printing.

Japanese Patent Application Publication No. 2003-72104 discloses technology in which a manifold guiding ejection material (e.g., ink) to a nozzle of a liquid ejection head is provided with a piezoelectric element for agitating the ejection material inside the manifold. By continuously agitating the ejection material inside the manifold by means of the piezoelectric element, the ejection material immediately prior to ejection is maintained in a state of stable dispersion of micro-particles.

However, in some cases, it is difficult to achieve efficient agitation of liquid in which dispersed micro-particles are suspended.

In particular, in a liquid ejection apparatus having a liquid ejection head in which the liquid ejection face is situated in a bottommost position, nozzle blockages are liable to occur due to sedimented micro-particles in the nozzles. In the case of a so-called shuttle head structure in which the liquid ejection head performs a reciprocal back and forth movement, the liquid inside the liquid ejection head is agitated by the reciprocal motion of the liquid ejection head, but in the case of a line head structure where the liquid ejection head does not perform reciprocal movement, the liquid is not agitated usually.

As described above, technology has been proposed for carrying out various maintenance operations, such as the vertical swinging of the liquid ejection head, the slight vibration of the free surface of the ink in the nozzle, the discarding of the ink, and the like; however, these operations are difficult to apply in practice, since they are not efficient because of long waiting times, increased costs, and so on.

For example, in Japanese Patent Application Publication No. 2004-167698, the liquid ejection head is caused to swing in the substantially vertical direction by means of the cam pressing the projection arranged on the bottom of the liquid ejection head; however, the liquid ejection head performs no reciprocal back and forth movement. The liquid having the aggregated and settled micro-particles in the liquid cartridge is thus agitated only by the displacement of the liquid ejection head in the substantially perpendicular direction, and hence the agitation performance is low and a long time is required until the liquid is agitated to a satisfactory extent.

In Japanese Patent Application Publication No. 2004-216809, since valuable liquid is ejected and discarded when the apparatus is not in printing, there is a problem in that costs increase.

In Japanese Patent Application Publication No. 2003-72104, since the dispersed state of the micro-particles is maintained by continuously agitating the liquid by means of the piezoelectric element, then it is not effective unless the piezoelectric element continuously carries out the agitating operation even while the apparatus is not operating, and it results in high power consumption and increased costs.

Furthermore, if a structure is adopted in which a common liquid chamber is arranged at a position higher than pressure chambers and the base of the common liquid chamber is connected to the pressure chambers through liquid supply channels, then the high-density liquid nearby the base of the common liquid chamber in which the micro-particles have settled is supplied to the pressure chambers, and hence there is a progressive density change (from thick to thin) in the liquid as being consumed by ejection. Consequently, quality deterioration occurs in the ejection results.

SUMMARY OF THE INVENTION

The present invention has been contrived in view of the foregoing circumstances, an object thereof being to provide a liquid ejection apparatus and a liquid maintenance method whereby it is possible to prevent deterioration of the quality of liquid as a result of aggregation and/or settling of micro-particles in the liquid, and to eject liquid in a stable fashion.

In order to attain the aforementioned object, the present invention is directed to a liquid ejection apparatus, comprising: a liquid ejection head which has nozzles ejecting liquid in a downward-facing state and pressure chambers connected to the nozzles; a turning device which turns the liquid ejection head to switch the nozzles of the liquid ejection head between the downward-facing state and an upward-facing state; and a sealing device which seals the nozzles when the nozzles of the liquid ejection head are in the upward-facing state.

According to the present invention, since the liquid ejection head is switched between the state where the nozzles are orientated in the downward direction and the state where the nozzles are orientated in the upward direction, by turning the liquid ejection head, and since the nozzles are sealed when the nozzles are in the upward-orientated state, then the micro-particles dispersed in the liquid do not aggregate and settle toward the free surface of the liquid in the nozzles, and therefore, blockages of the nozzles are prevented and the liquid can be ejected in a stable fashion.

Preferably, the turning device turns the liquid ejection head to make the liquid ejection head swing to agitate the liquid inside the liquid ejection head.

According to this aspect of the present invention, since the liquid ejection head is caused to swing and the liquid inside the liquid ejection head is agitated by turning the liquid ejection head, then the micro-particles that have aggregated and settled can be redispersed more readily in the liquid than in a case where the aggregated and settled micro-particles are displaced in the vertical direction only, and therefore density non-uniformities are eliminated and it is possible to eject the liquid of uniform density.

Preferably, the liquid ejection apparatus further comprises a vibrating device which vibrates the liquid in the pressure chambers slightly to an extent which does not cause the liquid to be ejected from the nozzles, during the turning device making the liquid ejection head swing.

According to this aspect of the present invention, the micro-particles that have aggregated and settled are broken up by the slight vibration of the liquid, and greater effect of agitation is obtained by the slight vibration.

In order to attain the aforementioned object, the present invention is also directed to a liquid maintenance method for maintaining a state of liquid inside a liquid ejection head which has nozzles ejecting the liquid and pressure chambers connected to the nozzles, the method comprising the step of: agitating the liquid inside the liquid ejection head by making the liquid ejection head swing by turning the liquid ejection head.

Preferably, in the agitating step, the liquid inside the pressure chambers is vibrated slightly to an extent which does not cause the liquid to be ejected from the nozzles, during swinging the liquid ejection head.

In order to attain the aforementioned object, the present invention is also directed to a liquid maintenance method for maintaining a state of liquid inside a liquid ejection head which has nozzles ejecting the liquid when the nozzles are in a downward-facing state, and pressure chambers connected to the nozzles, the method comprising the steps of: switching the nozzles of the liquid ejection head between the downward-facing state and an upward-facing state by turning the liquid ejection head; and sealing the nozzles when the nozzles of the liquid ejection head are in the upward-facing state.

According to the present invention, deterioration of liquid quality due to aggregation or settling of micro-particles in the liquid is prevented, and stable ejection of liquid is achieved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Liquid Ejection Head

Figure 1:
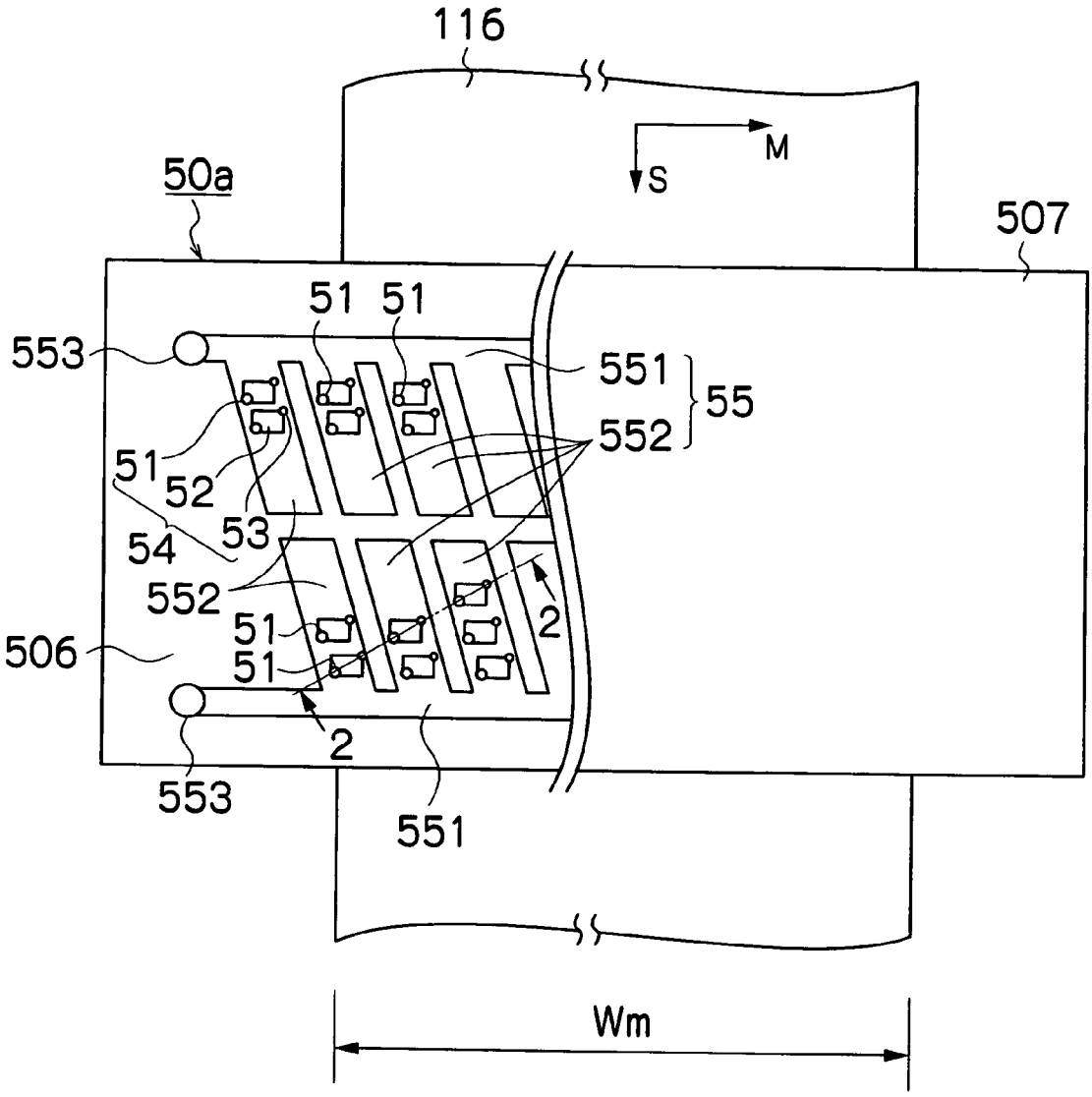
FIG. 1 is a plan view perspective diagram showing an approximate view of the general structure of a liquid ejection head according to an embodiment of the present invention.

FIG. 1 is a plan diagram showing the general structure of a liquid ejection head according to an embodiment of the present invention, giving a perspective view of the left-hand half in the diagram.

The liquid ejection head 50*a* shown in FIG. 1 is a so-called full line head, having a structure in which a plurality of liquid ejection ports or nozzles 51, which eject liquid toward an ejection receiving medium or a recording medium 116, are arranged through a length corresponding to a width Wm of the recording medium 116 in a main scanning direction indicated by arrow M in FIG. 1 perpendicular to a sub-scanning direction indicated by arrow S in FIG. 1, which is a conveyance direction of the recording medium 116.

More specifically, the liquid ejection head 50*a* has a composition in which a plurality of pressure chamber units 54, each having the nozzle 51, a pressure chamber 52 connected to the nozzle 51, and an opening section serving as a liquid supply port 53 to supply the liquid to the pressure chamber 52, are arranged two-dimensionally along two directions, namely, the main scanning direction, and an oblique direction forming a prescribed acute angle $\theta$ (where $0° < \theta < 90°$) with respect to the main scanning direction. In FIG. 1, in order to simplify the drawing, some of the pressure chamber units 54 are omitted from the drawing.

More specifically, by arranging the nozzles 51 at a uniform pitch of d in the direction forming the acute angle of $\theta$ with respect to the main scanning direction, it is possible to treat the nozzles 51 as being equivalent to an arrangement of nozzles at a prescribed pitch ($d \times \cos\theta$) in a straight line in the main scanning direction. According to this nozzle arrangement, for example, it is possible to achieve a composition substantially equivalent to a high-density nozzle arrangement reaching 4800 nozzles per inch in the main scanning direction. In other words, the effective nozzle pitch (projected nozzle pitch) obtained by projecting the nozzles to a straight line aligned with the lengthwise direction of the liquid ejection head 50*a* (the main scanning direction) can be reduced, and high image resolution can be achieved.

A common liquid chamber 55 (also called a "common flow channel") supplying the liquid or ink to the pressure chambers 52 includes a main channel 551 and distributary channels 552 branching from the main channel 551. An opening formed at an end of the main channel 551 serves as a liquid inlet port 553, through which the ink is introduced into the common liquid chamber 55 from the outside of the liquid ejection head 50*a* (more specifically, from a sub-tank 61 described later with reference to FIG. 7). The distributary channels 552 are connected to the pressure chambers 52 through the liquid supply ports 53 thereof.

In the present embodiment, the common liquid chamber 55 including the main channel 551 and the distributary channels 552 is formed by etching a metal plate (more specifically, a common liquid chamber forming plate 506 described later with reference to FIG. 2), and the rigidity of the common liquid chamber 55 is ensured.

Figure 2:
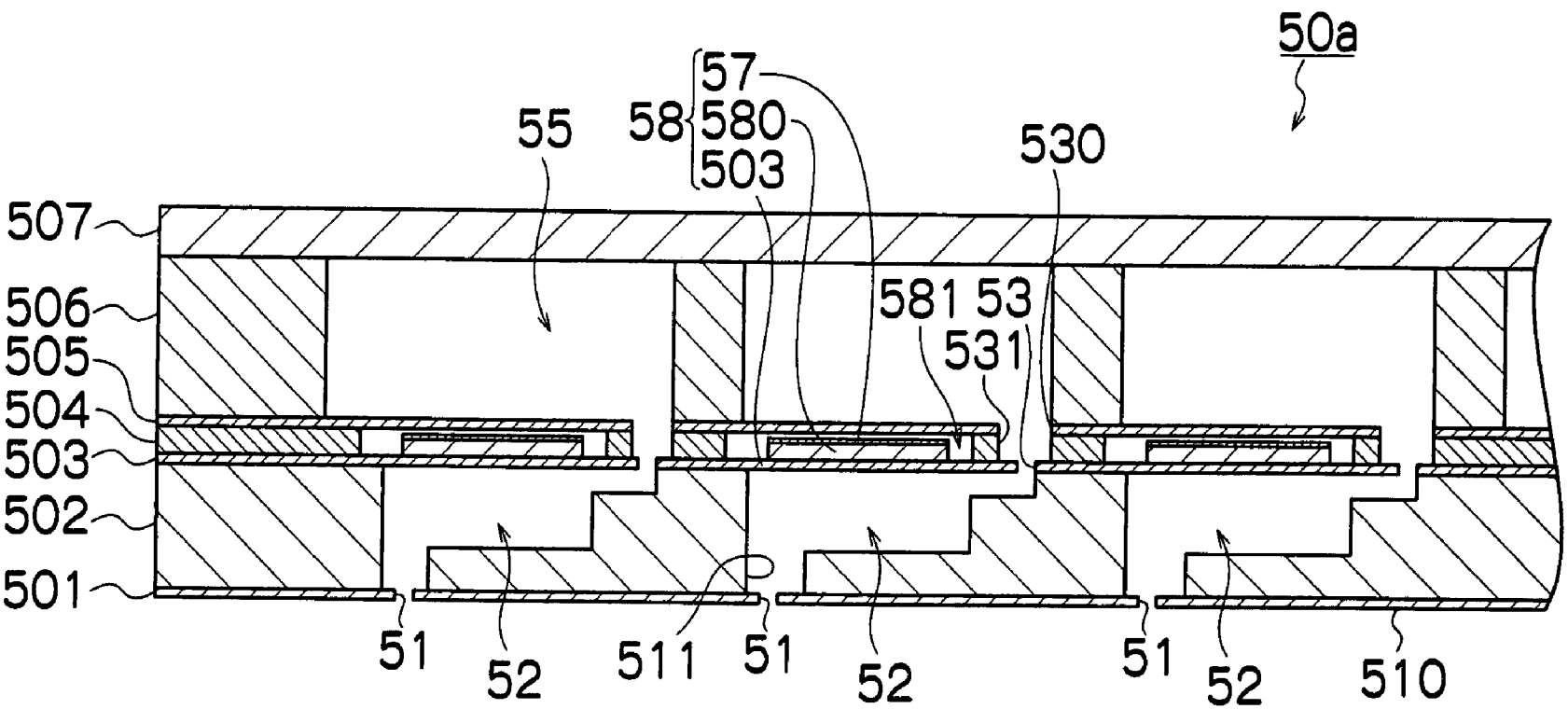
FIG. 2 is a cross-sectional diagram along line 2-2 in FIG. 1.

FIG. 2 shows a cross-sectional view along line 2-2 in FIG. 1. As shown in FIG. 2, the liquid ejection head 50*a* has a laminated structure of a plurality of plates including a nozzle forming plate 501, a pressure chamber forming plate 502, a diaphragm 503, actuator protection plates 504 and 505, the common liquid chamber forming plate 506, and a sealing plate 507.

The nozzles 51 ejecting the liquid are formed in a two-dimensional matrix fashion in the nozzle forming plate 501.

The pressure chambers 52 connected to the nozzles 51 are formed in the pressure chamber forming plate 502 bonded on the nozzle forming plate 501.

The diaphragm 503, on which actuators 58 are arranged, is bonded on the pressure chamber forming plate 502, and constitutes one face (a vibrating face) of each pressure chamber 52.

Each actuator 58 has a laminated structure of the diaphragm 503, a piezoelectric body 580 for generating pressure, and an individual electrode 57, such that the piezoelectric body 580 is arranged between the diaphragm 503 and the individual electrode 57. The piezoelectric body 580 is made of piezoelectric material such as PZT (lead zirconate titanate), and the diaphragm 503 and the individual electrode 57 are made of conductive material.

The actuators 58 are arranged on the diaphragm 503 at positions corresponding to the pressure chambers 52, and each actuator 58 functions as a pressure generating device causing the pressure inside the pressure chamber 52 to change by changing the volume of the pressure chamber 52.

The diaphragm 503 is grounded, and constitutes a common electrode for the actuators 58. The other electrodes for the actuators 58 are the individual electrodes 57, from which electrical wires (drive wires) for driving the actuators 58 extend.

The liquid supply ports 53 shown in FIG. 1 are formed in the diaphragm 503.

The actuator protection plates 504 and 505 are bonded on the diaphragm 503, and protect the whole actuators 58 while preventing any obstruction of the operation of the actuators 58 by creating spaces 581 around the actuators 58.

The common liquid chamber forming plate 506 is bonded on the actuator protection plate 505 on the side reverse to the side where the actuator protection plate 504, the diaphragm 503, and the pressure chamber forming plate 502 are arranged. The common liquid chamber 55 supplying the liquid to the pressure chambers 52 is formed in the common liquid chamber forming plate 506.

The sealing plate 507 constituting a ceiling of the common liquid chamber 55 is arranged on the common liquid chamber forming plate 506. The space between the actuator protection plate 505 and the sealing plate 507 constitutes the common liquid chamber 55, in which the liquid or ink is filled.

When viewed with the nozzles 51 positioned below the pressure chambers 52, the common liquid chamber 55 is arranged over the pressure chambers 52 and is connected to the pressure chambers 52 through liquid supply flow channels 531 extending from connecting ports 530, which are opening sections formed in the base of the common liquid chamber 55, passing through the actuator protection plates 504 and 505, to the liquid supply ports 53 formed in the diaphragm 503. In other words, the ink inside the common liquid chamber 55 flows directly to the pressure chambers 52 situated under the common liquid chamber 55 through the liquid supply flow channels 531, and good refilling characteristics are hence achieved in the supply of ink to the pressure chambers 52. Moreover, since the common liquid chamber 55 is disposed above the diaphragm 503, then the length of nozzle flow channels 511 from the pressure chambers 52 to the nozzles 51 is short, and it becomes possible to eject ink of high viscosity (for example, approximately 20 cP to 50 cP).

There are no particular restrictions on arrangement of the drive wires for the actuators 58. For example, it is possible to arrange the drive wires to pass through the common liquid chamber forming plate 506 in the vertical direction inside partitions defining the liquid chamber 55. In this case, it is possible to arrange the pressure chambers 52 and the nozzles 51 at higher density compared with a case where the drive wires are arranged in the horizontal direction. It is also possible to arrange the drive wires on the actuator protection plate 505 in the horizontal direction.

When a drive signal is supplied to the individual electrode 57 of the actuator 58 through the drive wire, the piezoelectric body 580 of the actuator 58 is displaced, and the volume of the pressure chamber 52 is changed through the diaphragm 503. Accordingly, the liquid in the pressure chamber 52 is ejected from the nozzle 51 connected to the pressure chamber 52.

Figure 3:
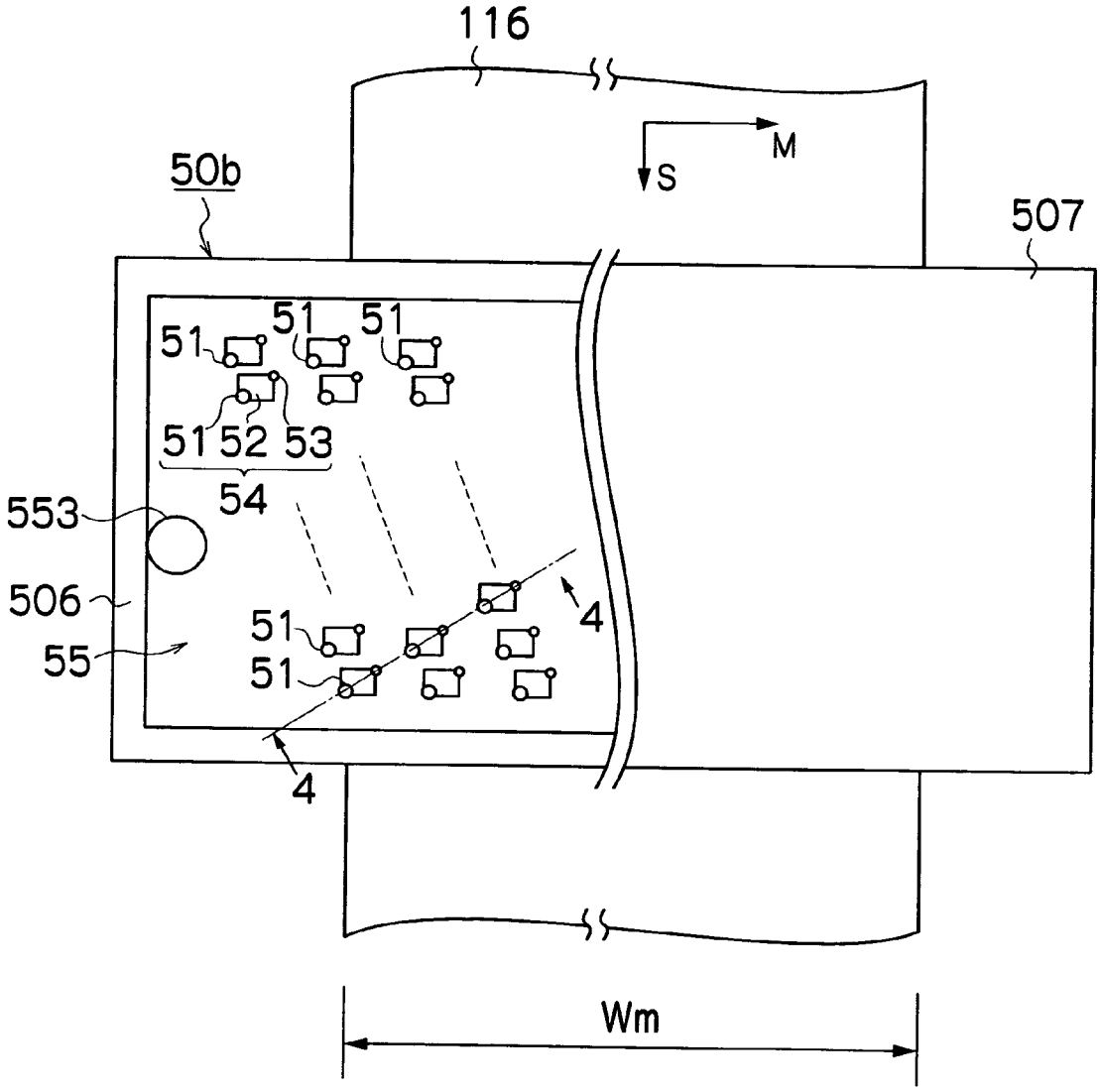
FIG. 3 is a plan view perspective diagram showing the general structure of a liquid ejection head according to a further embodiment of the present invention.
Figure 4:
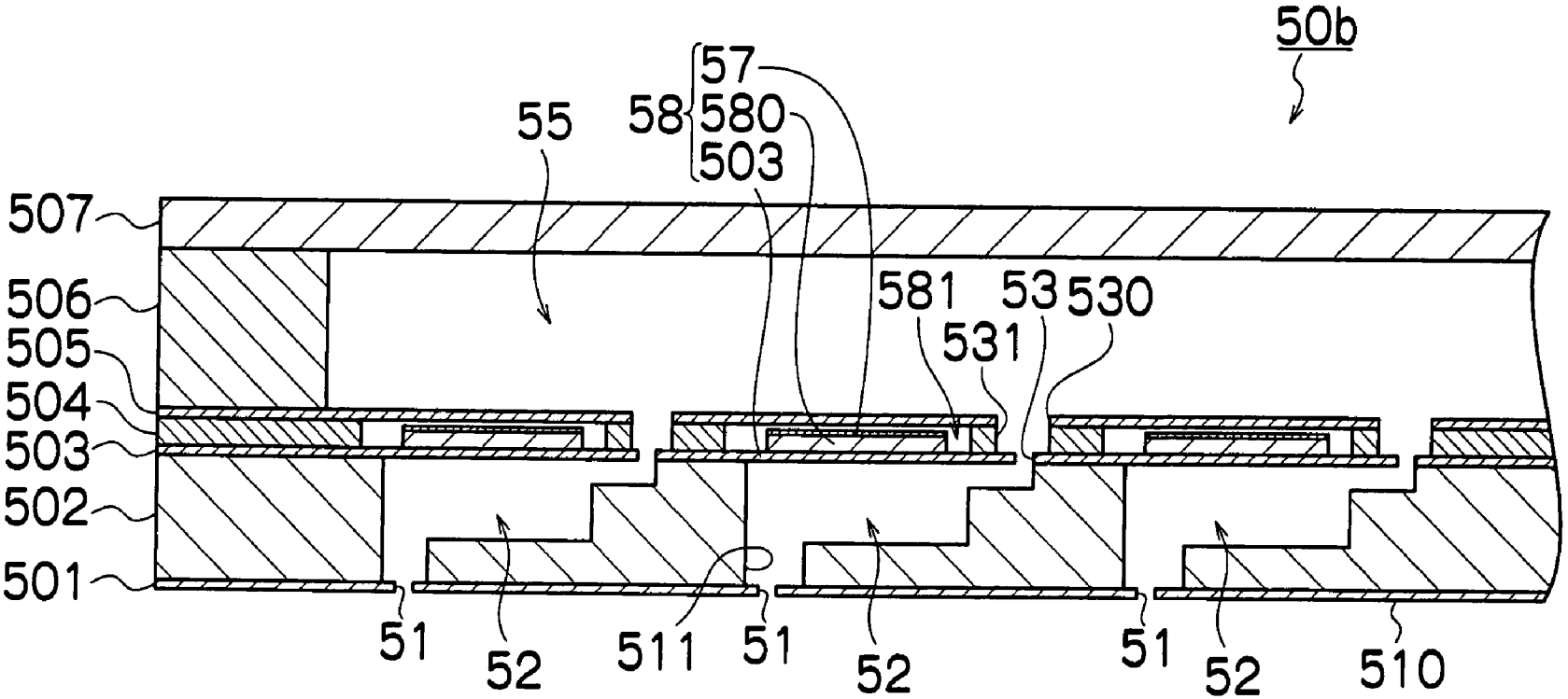
FIG. 4 is a cross-sectional diagram along line 4-4 in FIG. 3.

FIG. 3 is a plan diagram showing the general structure of a liquid ejection head 50*b* according to another embodiment of the present invention, giving a perspective view of the left-hand half in the diagram. FIG. 4 shows a cross-sectional diagram along line 4-4 in FIG. 3.

In the liquid ejection head 50*b* shown in FIGS. 3 and 4, the constituent elements that are the same as elements of the liquid ejection head 50*a* shown in FIGS. 1 and 2 are denoted with the same reference numerals, and description thereof is omitted here.

In the present embodiment, the common liquid chamber 55 is formed in the common liquid chamber forming plate 506 as a flow channel that occupies a single space covering all of the pressure chambers 52, rather than having the structure composed of the main channel and the distributary channels. It is thereby possible to increase the size of the common liquid chamber 55 and to reduce the flow channel resistance inside the common liquid chamber 55, and hence the present embodiment is suitable for the ejection of high-viscosity liquid.

In implementing the present invention, the arrangement structure of the nozzles 51, and the like, is not limited in particular to the embodiment shown in FIG. 1 or 3. For example, it is also possible to compose a full line liquid ejection head by adopting a staggered arrangement of a plurality of short liquid ejection head blocks each comprising a plurality of nozzles 51 arranged two-dimensionally, thus achieving a long head by joining these liquid ejection head blocks together.

General Composition of Image Forming Apparatus

Figure 5:
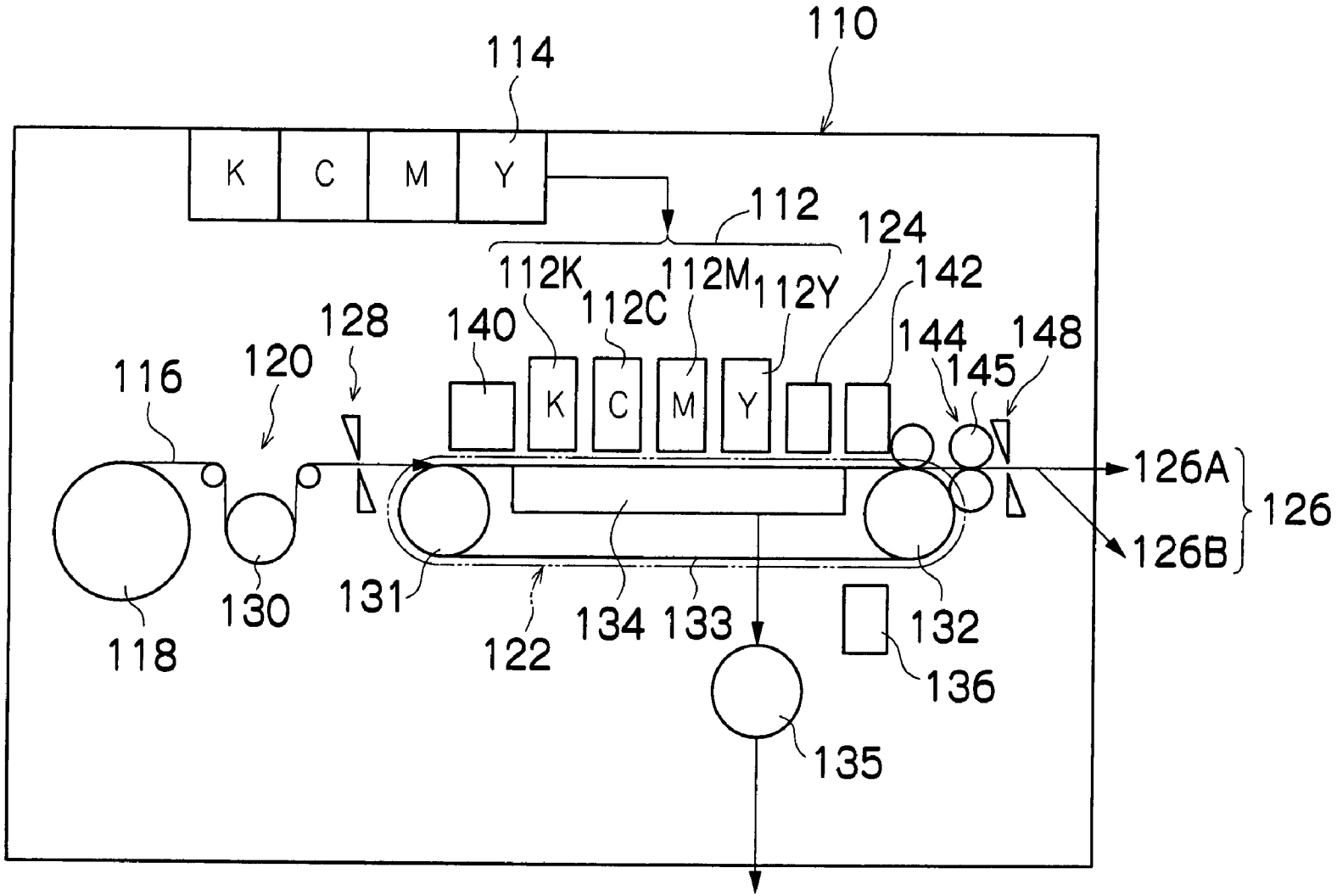
FIG. 5 is a diagram showing the general functional composition of an image forming apparatus according to an embodiment of the present invention.

FIG. 5 is a schematic drawing showing a general view of an image forming apparatus 110 according to an embodiment of the present invention. The image forming apparatus 110 comprises a plurality of the liquid ejection heads 50*a* shown in FIGS. 1 and 2, or the liquid ejection heads 50*b* shown in FIGS. 3 and 4, and these heads are denoted in FIG. 5 with reference numerals "112" appended with letters indicating the colors of ink ejected (K: black, C: cyan, M: magenta, and Y: yellow).

More specifically, the image forming apparatus 110 comprises: a liquid ejection unit 112 having the liquid ejection heads 112K, 112C, 112M and 112Y for respective ink colors; an ink storing and loading unit 114, which stores the inks to be supplied to the liquid ejection heads 112K, 112C, 112M and 112Y; a paper supply unit 118, which supplies a recording medium 116, such as paper; a decurling unit 120, which removes curl in the recording medium 116; a belt conveyance unit 122, which is disposed facing the nozzle face of the liquid ejection unit 112 and conveys the recording medium 116 while keeping the recording medium 116 flat; a print determination unit 124, which reads the ejection result (liquid droplet deposition state) produced by the liquid ejection unit 112; and a paper output unit 126, which outputs printed recording medium to the exterior.

By depositing liquids (inks) containing coloring agents (also referred to as coloring material) on the recording medium 116 from the liquid ejection heads 112K, 112C, 112M and 112Y, an image is formed on the recording medium 116.

The ink contains an insoluble or slightly water-soluble coloring material dispersed in water, and examples of the coloring material include, for instance, a dispersive dye, a metal complex dye, a pigment, or the like. Examples of dispersing agents for the coloring material in the ink dispersion, it is possible to use a so-called dispersant, surfactant, a resin, or the like. Examples of the dispersant or surfactant include anionic or nonionic materials, and examples of the resin dispersant include styrene or derivatives, vinylnaphthalene or derivatives, acrylic acid or derivatives, and the like. Desirably, the resin dispersant is alkali-soluble resin, which can be dissolved in an aqueous solution containing a basic material. The pigment may be an organic pigment or an inorganic pigment, but it is not limited to these. Pigment-based inks have excellent resistance to light and water; however, they tend to sediment more readily than dye-based inks.

In FIG. 5, a supply of rolled paper (continuous paper) is displayed as one embodiment of the paper supply unit 118, but it is also possible to use a supply unit which supplies cut paper that has been cut previously into sheets. In a case where rolled paper is used, a cutter 128 is provided. The recording medium 116 delivered from the paper supply unit 118 generally retains curl. In order to remove this curl, heat is applied to the recording medium 116 in the decurling unit 120 by a heating drum 130 in the direction opposite to the direction of the curl. After decurling in the decurling unit 24, the cut recording medium 116 is delivered to the belt conveyance unit 122.

The belt conveyance unit 122 has a configuration in which an endless belt 133 is set around rollers 131 and 132 so that the portion of the endless belt 33 facing at least the nozzle face of the liquid ejection unit 112 and the sensor face of the ejection determination unit 124 forms a horizontal plane. The belt 133 has a width that is greater than the width of the recording medium 116, and a plurality of suction apertures are formed on the belt surface. A suction chamber 134 is disposed in a position facing the sensor surface of the ejection determination unit 124 and the nozzle surface of the liquid ejection unit 112 on the interior side of the belt 133, which is set around the rollers 131 and 132, as shown in FIG. 5; and this suction chamber 134 provides suction with a fan 135 to generate a negative pressure, thereby holding the recording medium 116 onto the belt 133 by suction. The belt 133 is driven in the clockwise direction in FIG. 5 by the motive force of a motor (not shown) being transmitted to at least one of the rollers 131 and 132, which the belt 133 is set around, and the recording medium 116 held on the belt 133 is conveyed from left to right in FIG. 5. Since ink adheres to the belt 133 when a marginless print or the like is formed, a belt cleaning unit 136 is disposed in a predetermined position on the exterior side of the belt 133. A heating fan 140 is provided on the upstream side of the liquid ejection unit 112 in the paper conveyance path formed by the belt conveyance unit 122. This heating fan 140 blows heated air onto the recording medium 116 before printing, and thereby heats up the recording medium 116. Heating the recording medium 116 immediately before printing has the effect of making the ink dry more readily after landing on the paper.

Figure 6:
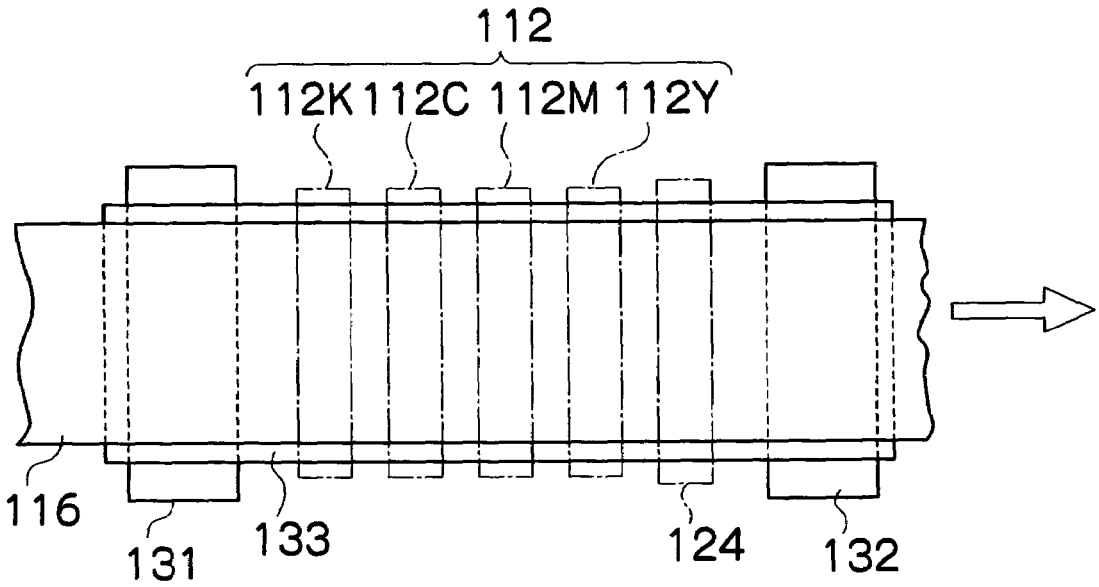
FIG. 6 is a plan diagram showing the principal part of an image forming system of the image forming apparatus.

FIG. 6 is a principal plan diagram showing the liquid ejection unit 112 of the image forming apparatus 110, and the peripheral region of the liquid ejection unit 112.

In FIG. 6, the liquid ejection heads 112K, 112C, 112M and 112Y constituting the liquid ejection unit 112 are arranged following a direction perpendicular to the medium conveyance direction (sub-scanning direction) (in other words, they are arranged in the main scanning direction), and they are full line heads having the nozzles (ejection ports) arranged through a length exceeding at least one edge of the maximum-size recording medium 116 that can be used in the image forming apparatus 110.

The liquid ejection heads 112K, 112C, 112M and 112Y corresponding to the respective ink colors are disposed in the order, black (K), cyan (C), magenta (M) and yellow (Y), from the upstream side (left-hand side in FIG. 6), following the direction of conveyance of the recording medium 116 (the sub-scanning direction). A color image can be formed on the recording medium 116 by ejecting the inks including coloring material from the print heads 112K, 112C, 112M and 112Y, respectively, toward the recording medium 116 while conveying the recording medium 116.

The liquid ejection unit 112, in which the full-line heads are thus provided for the respective ink colors, can record an image over the entire surface of the recording medium 116 by moving the recording medium 116 and the liquid ejection unit 112 relatively to each other in the medium conveyance direction (sub-scanning direction) just once (in other words, by means of a single sub-scanning action). Higher-speed printing is thereby made possible and productivity can be improved in comparison with a shuttle type head which moves reciprocally back and forth in the main scanning direction.

The terms "main scanning direction" and "sub-scanning direction" are used in the following senses. In a full-line head comprising rows of nozzles that have a length corresponding to the entire width of the recording medium, "main scanning" is defined as printing one line (a line formed of a row of dots, or a line formed of a plurality of rows of dots) in the breadthways direction of the recording medium (the direction perpendicular to the conveyance direction of the recording medium) by driving the nozzles in one of the following ways: (1) simultaneously driving all the nozzles; (2) sequentially driving the nozzles from one side toward the other; and (3) dividing the nozzles into blocks and sequentially driving the nozzle from one side toward the other in each of the blocks. The direction indicated by one line recorded by a main scanning action (the lengthwise direction of the band-shaped region thus recorded) is called the "main scanning direction".

On the other hand, sub-scanning is defined as printing the line (a line constituted by a single dot array or a line constituted by a plurality of dot arrays) formed by the main scanning described above repeatedly by moving the full line head and recording medium relative to each other as described above. The direction in which this sub-scanning is performed is known as the sub-scanning direction. Consequently, the recording medium conveyance direction is the sub-scanning direction, and the direction perpendicular to the sub-scanning direction is the main scanning direction.

Although a configuration with the four standard colors, K, C, M and Y, is described in the present embodiment, the combinations of the ink colors and the number of colors are not limited to those of the present embodiment, and light and/or dark inks can be added as required. For example, a configuration is possible in which liquid ejection heads for ejecting light-colored inks such as light cyan and light magenta are added.

As shown in FIG. 5, the ink storing and loading unit 114 has ink tanks for storing the inks of the colors corresponding to the liquid ejection heads 112K, 112C, 112M and 112Y, and the ink tanks are connected to the liquid ejection heads 112K, 112C, 112M and 112Y through channels (not shown).

The ejection determination unit 124 has an image sensor (line sensor, or the like) for capturing an image of the ejection result of the liquid ejection unit 112, and functions as a device to check for ejection defects such as blockages of the nozzles in the liquid ejection unit 12 on the basis of the image read in by the image sensor.

A post-drying unit 142 is provided at a downstream stage from the ejection determination unit 124. The post-drying unit 142 is a device for drying the printed image surface, and it may comprise a heating fan, for example. A heating and pressurizing unit 144 is provided at a stage following the post-drying unit 142. The heating and pressurizing unit 144 is a device which serves to control the luster of the image surface, and it applies pressure and heat to the image surface by means of pressure rollers 145 having prescribed surface undulations. Accordingly, an undulating form is transferred to the image surface.

The printed object generated in this manner is output via the paper output unit 126. In the image forming apparatus 110, a sorting device (not shown) is provided for switching the outputting pathway in order to sort the printed matter with the target print and the printed matter with the test print, and to send them to output units 126A and 126B, respectively. If the main image and the test print are formed simultaneously in a parallel fashion, on a large piece of printing paper, then the portion corresponding to the test print is cut off by means of the cutter (second cutter) 140. The cutter 140 is disposed immediately in front of the paper output section 126, and serves to cut and separate the main image from the test print portion, in cases where a test image is printed onto the white margin of the image. Moreover, although omitted from the drawing, a sorter for collating and stacking the images according to job orders is provided in the paper output section 126A corresponding to the main images.

Figure 7:
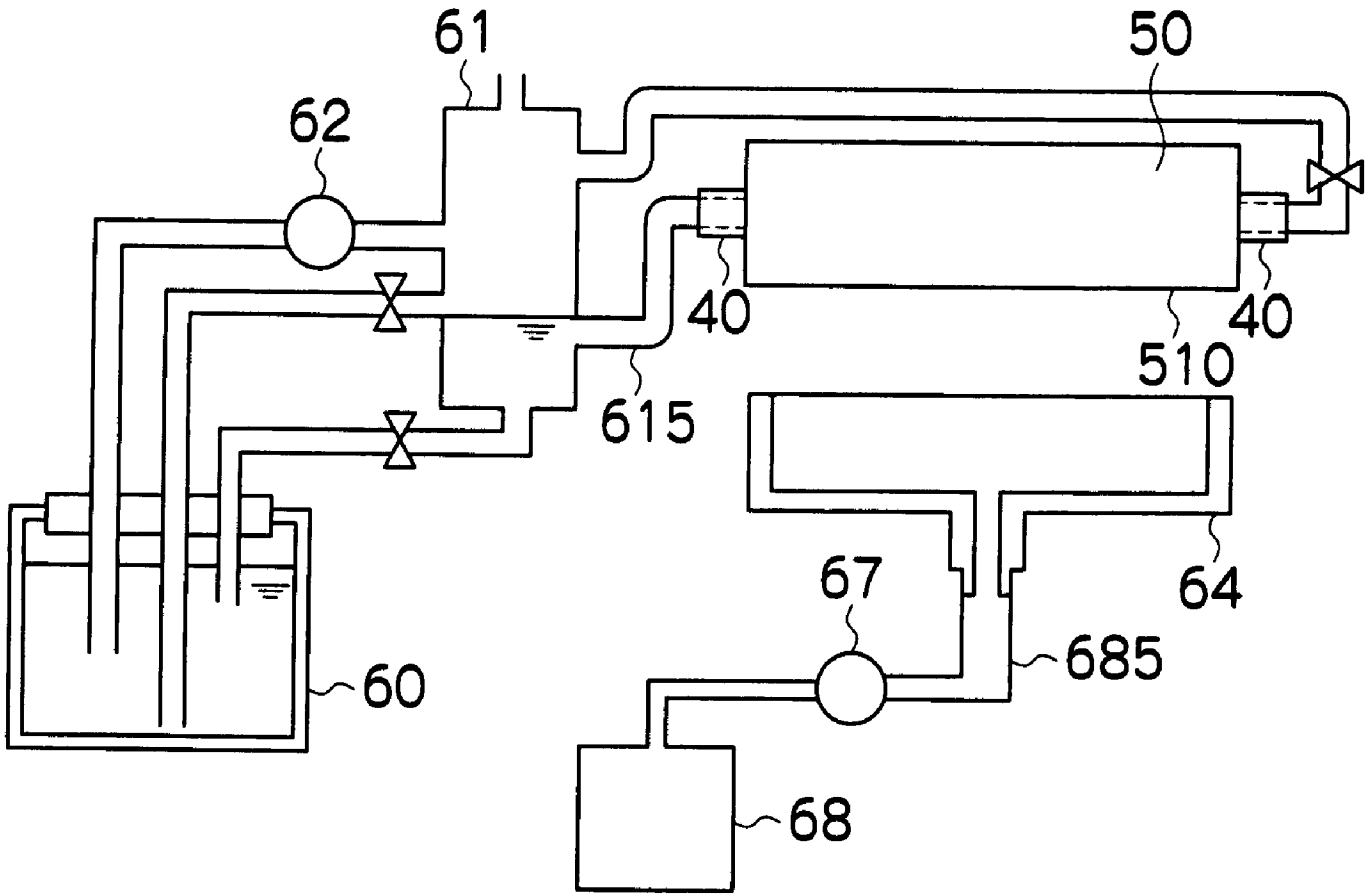
FIG. 7 is a schematic drawing showing the principal part of a liquid flow system of the image forming apparatus.

FIG. 7 is a schematic diagram showing the composition of a liquid supply system in the image forming apparatus 110. In FIG. 7, the reference numeral 50 denotes the liquid ejection head.

The main tank 60 is a source of the liquid to be supplied to the liquid ejection head 50, and corresponds to the ink storing and loading unit 114 in FIG. 5. The liquid in of the main tank 60 is supplied to the sub-tank 61 by means of a liquid supply pump 62. The internal pressure of the liquid ejection head 50 is adjusted to a negative pressure, by means of the positional relationship between the free surface of the liquid in the sub-tank 61 and the nozzle surface 510 of the liquid ejection head 50. A liquid supply channel 615 linking the sub-tank 61 with the liquid ejection head 50 passes along a turning axis 40 of the liquid ejection head 50 and is connected to the common liquid chamber 55 in the liquid ejection head 50 (and more specifically, to the liquid inlet port 553 shown in FIGS. 1 and 3).

A liquid receptacle 64 is formed in a recessed shape, and receives liquid ejected by dummy ejection from the nozzles 51 of the liquid ejection head 50 in a state where the liquid receptacle 64 is in tight contact with the nozzle surface 510 of the liquid ejection head 50 or opposes the nozzle surface 510 of the liquid ejection head 50. When a liquid suction pump 67 is driven in the state where the liquid receptacle 64 is in tight contact with the nozzle surface 510 of the liquid ejection head 50, the liquid inside the liquid ejection head 50 is suctioned from the nozzles 51 of the liquid ejection head 50, toward the liquid receptacle 64. The liquid received in the liquid receptacle 64 due to the dummy ejection and the suctioning is sent to a collection tank 68 via the liquid suction pump 67.

Figure 8:
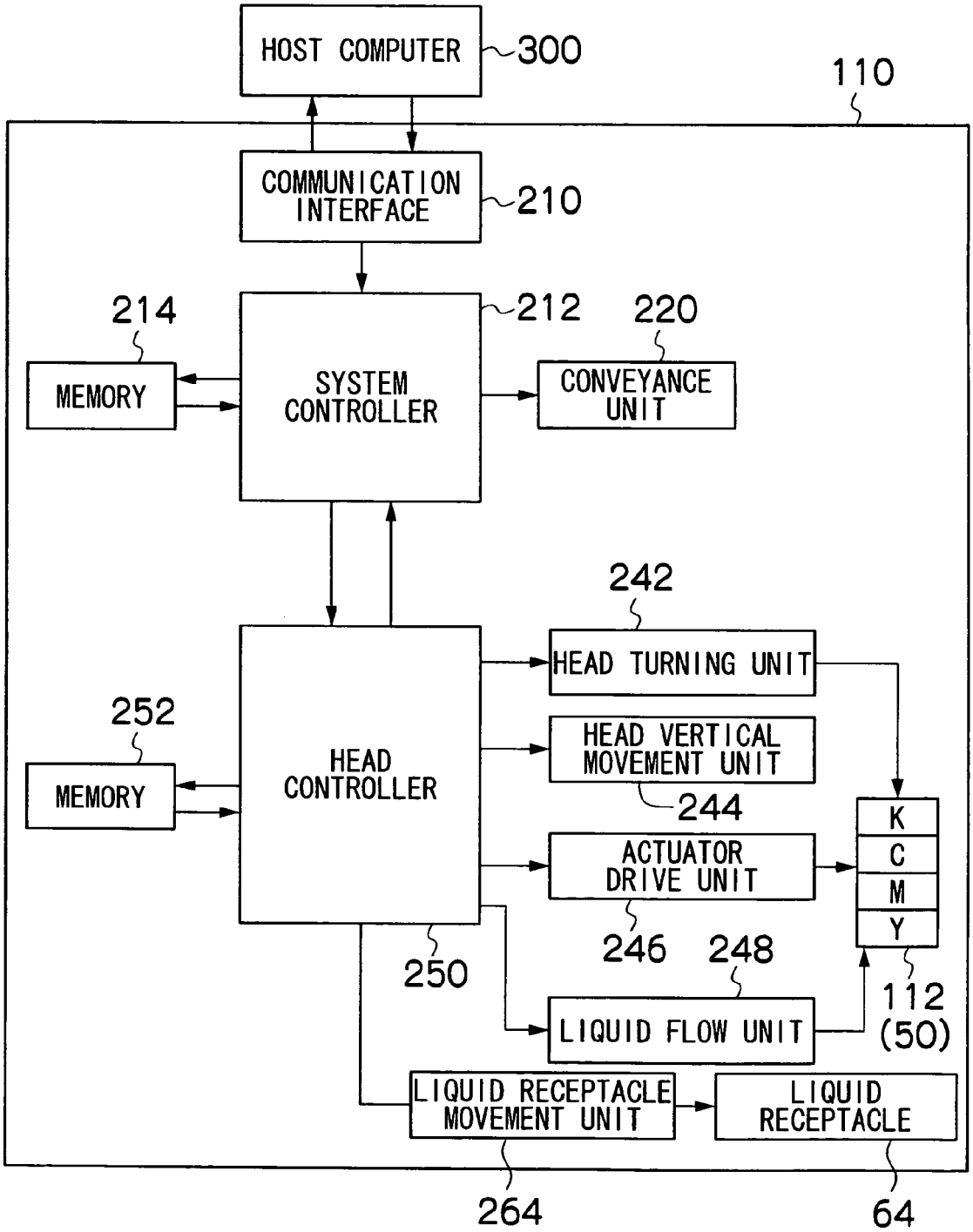
FIG. 8 is a block diagram showing the general composition of the image forming apparatus.

FIG. 8 is a block diagram showing the functional composition of the image forming apparatus 110. As shown in FIG. 8, the image forming apparatus 110 comprises: the liquid ejection unit 112, a communication interface 210, a system controller 212, memories 214 and 252, a conveyance unit 220, a head turning unit 242, a head vertical movement unit 244, an actuator drive unit 246, a liquid flow unit 248, a head controller 250, and a liquid receptacle movement unit 264.

The liquid ejection unit 112 is constituted by the plurality of liquid ejection heads 50, which respectively eject inks of the colors of black (K), cyan (C), magenta (M) and yellow (Y).

The communication interface 210 is an image data input device for receiving image data transmitted by a host computer 300. For the communication interface 210, a wired or wireless interface, such as a USB (Universal Serial Bus), IEEE 1394, or the like, can be used. The image data acquired by the image forming apparatus 110 via the communication interface 210 is stored temporarily in a first memory 214 for storing image data.

The system controller 212 is constituted by a microcomputer and peripheral circuits thereof, and the like, and it forms a main control device which controls the whole of the image forming apparatus 110 in accordance with a prescribed program. More specifically, the system controller 212 controls units of the communication interface 210, the conveyance unit 220, the head controller 250, and the like.

The conveyance unit 220 comprises a conveyance motor and driver circuit for same, and it conveys the recording medium 116 by using the rollers 131 and 132 and the belt 133 shown in FIG. 5. In other words, by means of the conveyance unit 220, the liquid ejection heads 50 and the recording medium 116 move relatively to each other.

The head turning unit 242 serves to turn the liquid ejection head 50 about its axis of turning. The mechanism (turning mechanism) of the head turning unit 242 is described in detail later.

The head vertical movement unit 244 moves the liquid ejection head 50 in a direction perpendicular to the conveyance surface of the recording medium 116. The mechanism (vertical movement mechanism) of the head vertical movement unit 244 is described in detail later.

The actuator drive unit 246 supplies drive signals to the actuators 48 of the liquid ejection head 50.

The liquid flow unit 248 is constituted by the main tank 60, the sub-tank 61, the liquid supply pump 62, the liquid suction pump 67, the collection tank 68, the channel for guiding the ink from the main tank 60 to the liquid ejection head 50, and the channel for guiding the ink from the liquid receptacle 64 to the collection tank 68, which are described above with reference to FIG. 7.

The liquid receptacle movement unit 264 moves the liquid receptacle 64 in the medium conveyance direction (the sub-scanning direction). The mechanism of the liquid receptacle movement unit 264 is described in detail later.

The head controller 250 is constituted by a microcomputer and peripheral circuits thereof, and the like, and it forms a control device which controls the liquid ejection heads 50 and peripheral units in accordance with a prescribed program.

The head controller 250 generates data (dot data), which is required when forming dots on a recording medium 116 by ejecting liquid toward the recording medium 116 from the liquid ejection heads 50 on the basis of the image data input to the image forming apparatus 110. More specifically, the head controller 250 is a control unit that functions as an image processing device carrying out various image treatment processes, corrections, and the like, in order to generate dot data from the image data stored in the first memory 214, in accordance with the control of the system controller 212, and the head controller 250 supplies the dot data thus generated to the actuator drive unit 246. When the dot data is supplied to the actuator drive unit 246, drive signals are output to the actuators 58 of the liquid ejection heads 50 from the actuator drive unit 246 according to the dot data, and liquid is ejected from the nozzles 51 of the liquid ejection heads 50 toward the recording medium 116.

Furthermore, the head controller 250 carries out various maintenance operations in order to maintain the state of the liquid inside the liquid ejection heads 50. More specifically, the head controller 250 implements operations for: turning the liquid ejection heads 50 by means of the head turning unit 242, vertically moving the liquid ejection heads 50 by means of the head vertical movement unit 244, causing slight vibration of the diaphragms 503 of the liquid ejection heads 50 by means of the actuator drive unit 246, performing dummy ejection (purging) from the nozzles 51 of the liquid ejection heads 50 by using the actuator drive unit 246 and the liquid flow unit 248, suctioning the liquid inside the liquid ejection heads 50 by using the liquid flow unit 248, and sealing the nozzles 51 of the liquid ejection heads 50 by using the head vertical movement unit 244. The details of these maintenance operations are described further later.

In FIG. 8, the second memory 252 is depicted as being appended to the head controller 250; however, it can be combined with the first memory 214. Also possible is a mode in which the head controller 250 and the system controller 212 are integrated to form a single micro-processor.

Maintenance Mechanism

The agitation of the liquid in the liquid ejection head 50 is performed by, firstly, swinging the liquid ejection head 50, and, secondly, slightly vibrating the liquid inside the liquid ejection head 50 by means of the actuators 58 of the liquid ejection head 50.

Hereinafter, the turning mechanism and the vertical movement mechanism used in the swinging of the liquid ejection head 50, and peripheral parts to the liquid ejection head 50, such as the liquid receptacle 64, are described in detail.

Figure 9:
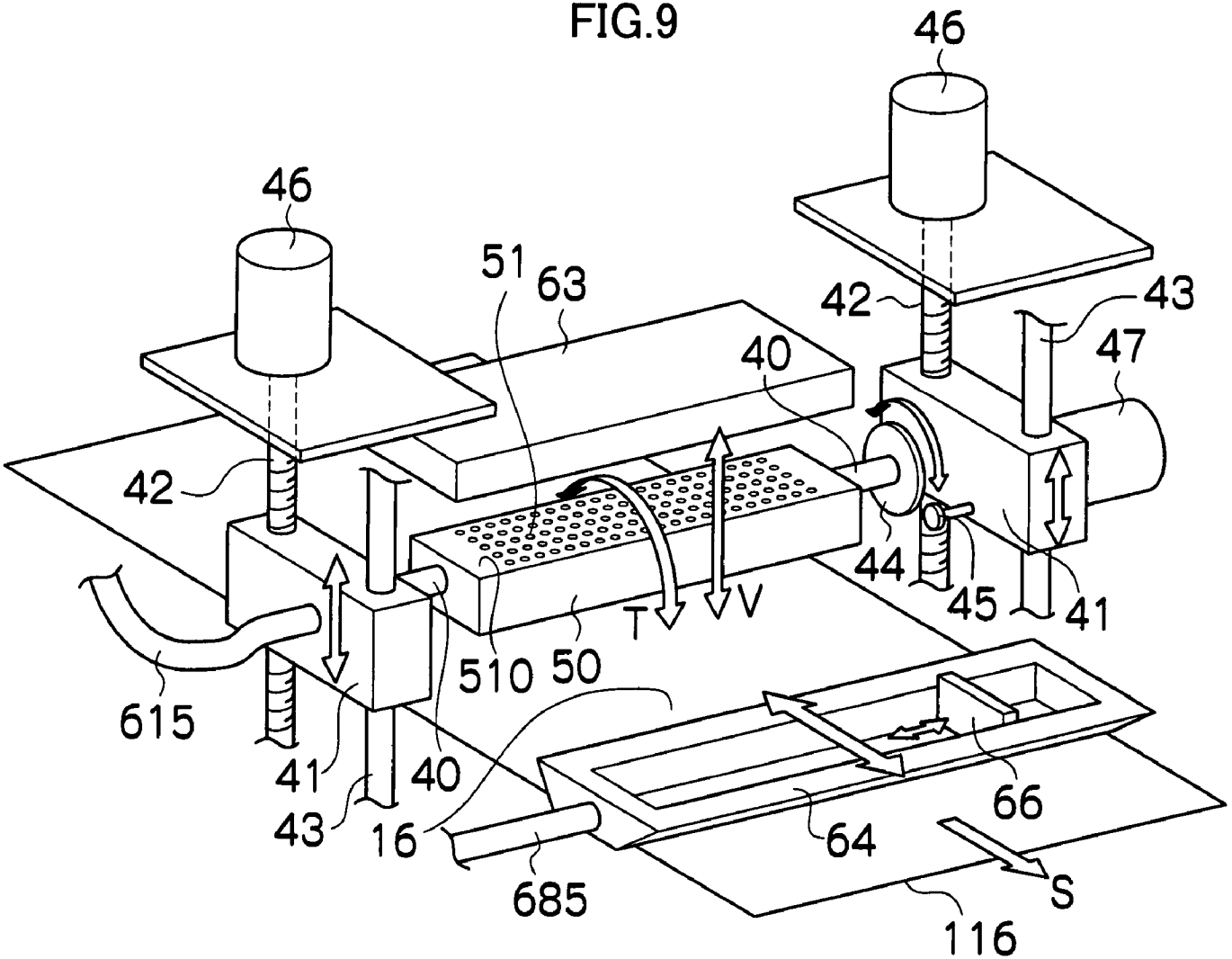
FIG. 9 is an oblique diagram showing a maintenance mechanism of the image forming apparatus.

FIG. 9 is an oblique diagram showing the liquid ejection head 50 and the peripheral area of same.

In FIG. 9, the liquid ejection head 50 is tunable on the turning axis 40 of the liquid ejection head 50 as denoted by a double-headed arrow T, and the liquid ejection head 50 is also vertically movable in the direction perpendicular to the conveyance surface 16 for the recording medium 116, as denoted by a double-headed arrow V.

The turning axis 40 is attached to the liquid ejection head 50 in the longitudinal direction of the liquid ejection head 50. In other words, the turning axis 40 forming the center of turning of the liquid ejection head 50 is disposed in a plane parallel with the conveyance surface 16 for the recording medium 116, following the main scanning direction, which is perpendicular to the medium conveyance direction denoted by an arrow S in FIG. 9.

The turning axis 40 of the liquid ejection head 50 is rotatably held by brackets 41 having ball bearings. In other words, the liquid ejection head 50 is rotatably held by the brackets 41 through the turning axis 40. A ball screw 42 and a guide shaft 43 arranged in a direction perpendicular to the conveyance surface 16 are installed on each bracket 41. In other words, the liquid ejection head 50 is supported movably in the vertical direction by means of the brackets 41. First motors 46 function as vertical movement drive units which move the liquid ejection head 50 by a prescribed distance in the direction perpendicular to the conveyance surface 16, by rotating the ball screws 42, which are connected respectively to the shafts of the first motors 46 through couplings (not shown).

In other words, the vertical movement mechanism vertically moving the liquid ejection head 50 is constituted by the brackets 41, the ball screws 42, the guide shafts 43 and the first motors 46.

A first gear wheel 44 is attached to the turning axis 40 of the liquid ejection head 50, and a second gear wheel 45 engages with the first gear wheel 44 and transmits the turning movement of the shaft of a second motor 47 to the first gear wheel 44 at a prescribed gear ratio. The second motor 47 functions as the turning drive unit, which turns the liquid ejection head 50 by a prescribed amount of turning, by rotating the two gear wheels 44 and 45 at the prescribed gear ratio.

In other words, the turning mechanism turning the liquid ejection head 50 is constituted by the brackets 41, the two gear wheels 44 and 45, and the second motor 47.

In the vertical movement mechanism described above, when the ball screws 42 are rotated by the first motors 46, then the brackets 41 move by a prescribed distance in the direction perpendicular to the conveyance surface 16, while being guided by the guide shafts 43, and consequently, the liquid ejection head 50 also moves in the direction perpendicular to the conveyance surface 16, in conjunction with these brackets 41.

In the turning mechanism described above, when the first gear wheel 44 attached to the turning axis 40 of the liquid ejection head 50 and the second gear wheel 45 coupled to the shaft of the second motor 47 are in an engaged state, and the two gear wheels 44 and 45 are rotated by driving the second motor 47, then the liquid ejection head 50 turns on the turning axis 40 of the liquid ejection head 50. In other words, the liquid ejection head 50 turns in a plane perpendicular to the conveyance surface 16, while the turning axis 40 is in the plane parallel to the conveyance surface 16 for the recording medium 116.

The turning mechanism is able to turn the liquid ejection head 50 by a prescribed, limited angle (for example, 45° or 90°).

The modes of controlling the amount of movement of the liquid ejection head 50 in the vertical direction and the amount of turning movement of the liquid ejection head 50 include a mode in which the movements are controlled on the basis of the number of pulses of the drive signals supplied to the motors 46 and 47, a mode in which sensors are provided and the movements are performed and halted by monitoring with the sensors, and a mode in which the positions are controlled by means of encoders.

A cap 63 is disposed at the end of the range of vertical movement of the liquid ejection head 50, on the opposite side to the conveyance surface 16, and the cap 63 seals the nozzles 51 of the liquid ejection head 50 when the nozzles 51 of the liquid ejection head 50 are facing vertically upward.

In other words, by turning the liquid ejection head 50 through a half turn by means of the turning mechanism when the nozzles 51 of the liquid ejection head 50 are facing downward, the nozzles 51 of the liquid ejection head 50 are set to an upward facing state (in other words, a state where the nozzle surface 510 opposes the cap 63), whereupon the nozzles 51 are sealed by pressing the liquid ejection head 50 against the cap 63 by means of the vertical movement mechanism. By turning the liquid ejection head 50 through the half turn and sealing the nozzles 51 by means of the cap 63 in this way, it is possible to prevent the micro-particles dispersed in the liquid inside the liquid ejection head 50 from aggregating and settling in the nozzles 51, as well as preventing evaporation of the liquid from the nozzles 51.

The liquid receptacle 64 is provided movably in parallel with the conveyance surface 16, in the medium conveyance direction S. More specifically, during suctioning or dummy ejection, after separating the nozzle surface 510 of the liquid ejection head 50 from the conveyance surface 16 by means of the vertical movement mechanism, the liquid receptacle 64 is moved in parallel with the conveyance surface 16, in the medium conveyance direction S, and is inserted in between the liquid ejection head 50 and the conveyance surface 16. In other words, by means of the parallel movement of the liquid receptacle 64, the liquid ejection head 50 is moved relatively in parallel to a position opposing the liquid receptacle 64. In the case of suctioning, the liquid ejection head 50 is then moved downward in the vertical direction by the vertical movement mechanism, and thereby the liquid ejection head 50 is engaged with the liquid receptacle 64, whereupon suctioning is carried out using the liquid receptacle 64. In the case of dummy ejection, there are a mode in which the liquid ejection head 50 is moved downward in the vertical direction, and a mode in which the liquid ejection head 50 is not moved.

The liquid receptacle 64 has a wiper 66 movable in the direction perpendicular to the medium conveyance direction S (namely, in the main scanning direction) in such a manner that the wiper 66 wipes over the nozzle surface 510 of the liquid ejection head 50.

Figure 10:
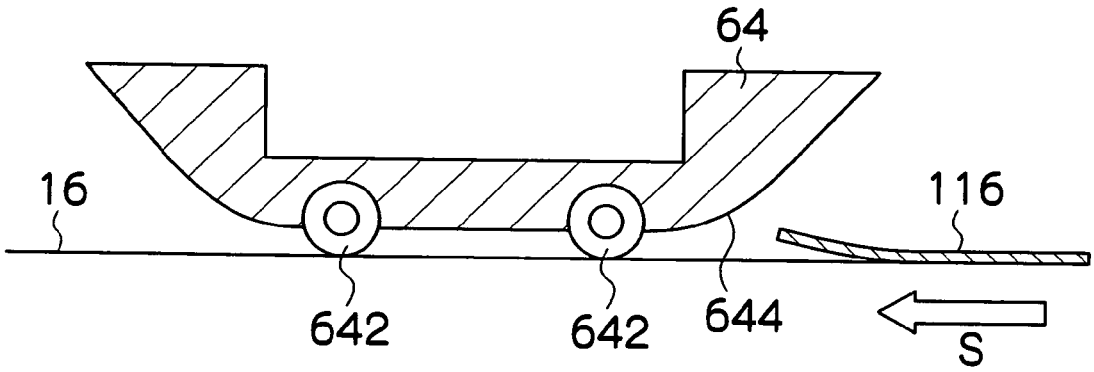
FIG. 10 is a cross-sectional diagram showing a liquid receptacle of the image forming apparatus.

FIG. 10 is a cross-sectional diagram of the liquid receptacle 64 taken along the medium conveyance direction S. As shown in FIG. 10, the liquid receptacle 64 has rollers 642, which are provided on the adjacent side to the conveyance surface 16 and make point contacts with the recording medium 116, so as to prevent the recording medium 116 from floating up from the conveyance surface 16. On the upstream side of these rollers 642 in terms of the medium conveyance direction S, a slant 644 is provided for guiding the recording medium 116 in between the liquid receptacle 64 and the conveyance surface 16. Thereby, it is possible to convey the recording medium 116 stably.

In the present embodiment, since the liquid ejection head 50 can be separated from the conveyance surface 16 for the recording medium 116 in the vertical direction by means of the ball screws 42, then by retracting the liquid ejection head 50 by means of the ball screws 42 prior to turning the liquid ejection head 50, it is possible to avoid contact between the liquid ejection head 50 and the conveyance surface 16, even if there is little clearance between the conveyance surface 16 and the nozzle surface 510 of the liquid ejection head 50. Moreover, since the ball screws 42 are used, then it is possible accurately to maintain a uniform distance between the nozzle surface 510 of the liquid ejection head 50 and the recording medium 116, and furthermore, it is also possible to adjust the pressing force when the liquid ejection head 50 is pressed against the cap 63.

It is also possible to use a link or a cam, instead of the ball screws 42, in order to achieve vertical movement of the liquid ejection head 50.

Maintenance Operation

Figure 11:
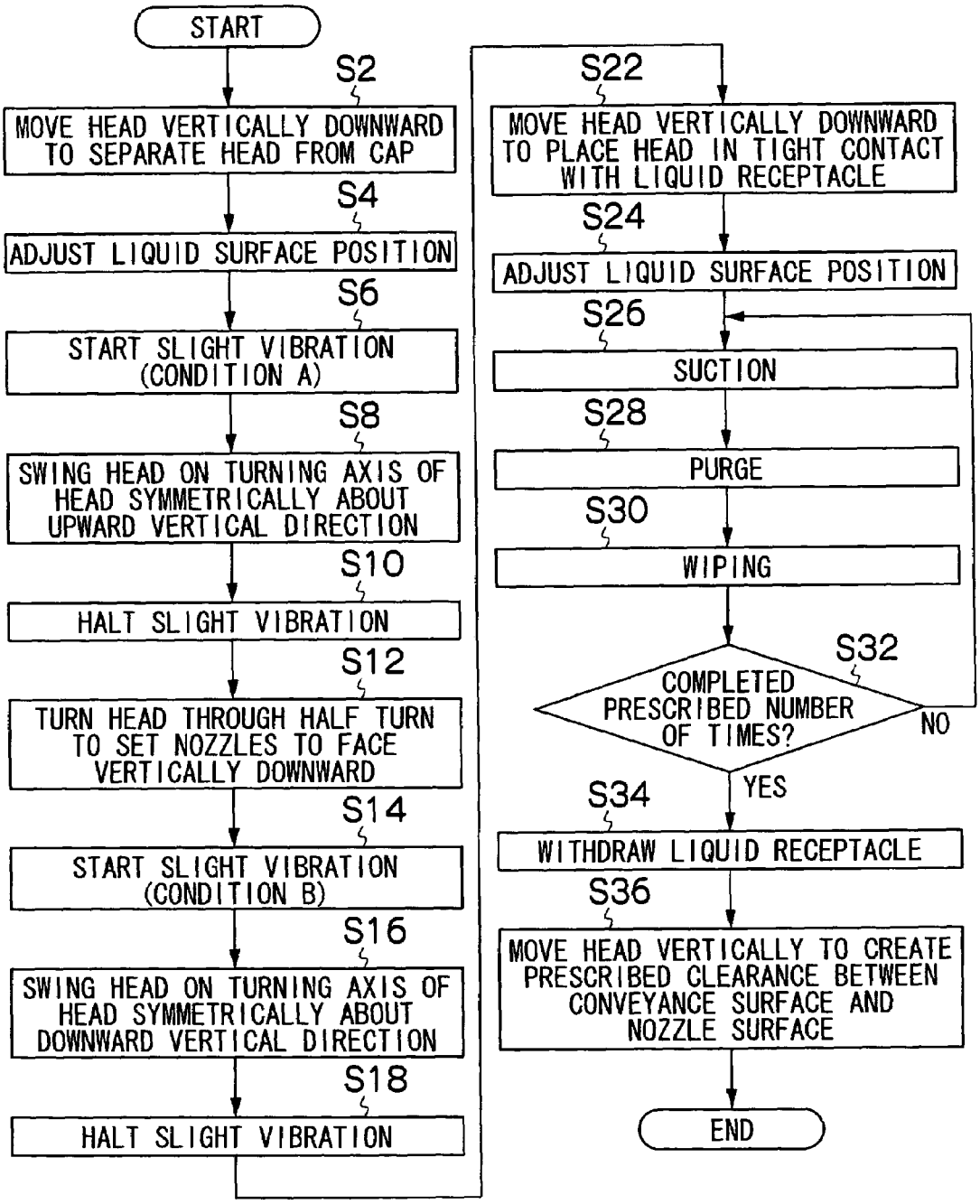
FIG. 11 is a flowchart showing a maintenance sequence that is carried out before image formation in the image forming apparatus.

FIG. 11 is a flowchart showing an embodiment of a maintenance sequence that is carried out prior to image formation.

Before carrying out the maintenance sequence in FIG. 11, the image forming apparatus 110 is in a power off state or a standby state awaiting a print instruction, the nozzles 51 of the liquid ejection head 50 are orientated vertically upward and sealed with the cap 63 for preventing drying, and the liquid receptacle 64 is arranged between the liquid ejection head 50 and the conveyance surface 16. In this state, when the power of the image forming apparatus 110 is switched on and a print instruction is input to the image forming apparatus 110, then the maintenance sequence shown in FIG. 11 starts.

Firstly, the liquid ejection head 50 is separated from the cap 63 by moving the liquid ejection head 50 vertically downward (S2).

Then, the positions of the free surfaces of the liquid in the nozzles 51 of the liquid ejection head 50 are adjusted in accordance with the vertical movement distance of the liquid ejection head 50 (S4). If there is no change in the positions of the free surfaces of the liquid in the nozzles 51 due to the vertical movement of the liquid ejection head 50, then this adjustment is not necessary. The adjustment of the positions of the free surfaces of the liquid in the nozzles 51 is described in detail hereinafter.

Next, a slight vibration of the diaphragm 503 is started by driving the actuators 58 of the liquid ejection head 50 (S6), and the liquid ejection head 50 is turned by the turning mechanism on the turning axis 40 of the liquid ejection head 50 in the plane perpendicular to the conveyance surface 16, symmetrically on either side of the upward direction perpendicular to the conveyance surface 16 within a prescribed angular range, thereby causing the liquid ejection head 50 to perform a swinging motion (S8).

Figure 14A:
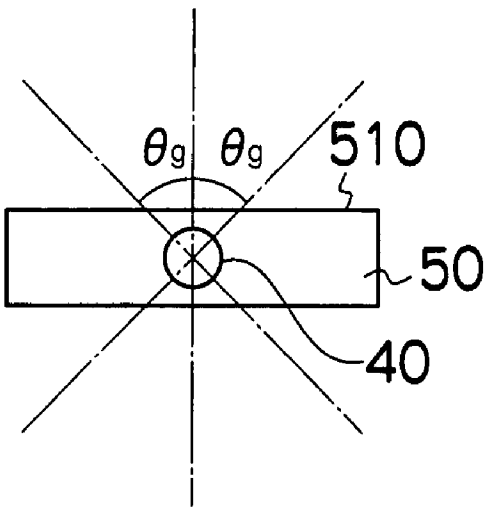
FIGS. 14A to 14C are side view diagrams showing the aspects of an upward-facing swinging motion of the liquid ejection head.
Figure 14B:
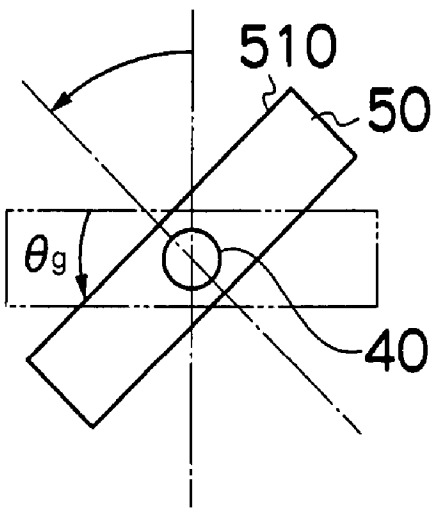
Figure 14C:
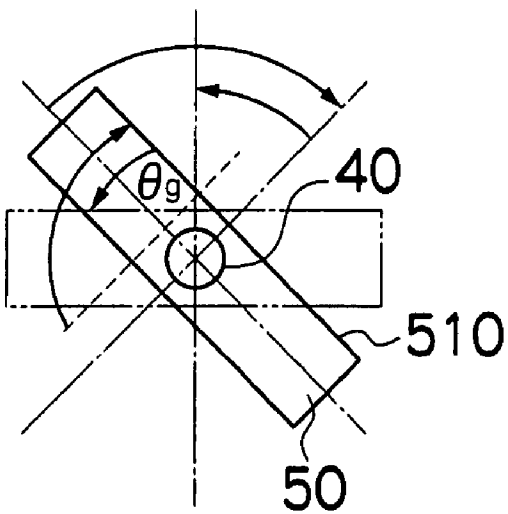

The swinging motion of the liquid ejection head 50 is described below in further detail with reference to FIGS. 14A to 14C. When the liquid ejection head 50 is turned through 45° in the counter-clockwise direction from a state shown in FIG. 14A where the normal to the nozzle surface 510 of the liquid ejection head 50 is orientated in the upward vertical direction, then as shown in FIG. 14B, the normal to the nozzle surface 510 becomes inclined at −45° with respect to the upward vertical direction. The direction of turning is reversed in this state, and the liquid ejection head 50 is turned through 90° in the clockwise direction, then as shown in FIG. 14C, the normal to the nozzle surface 510 of the liquid ejection head 50 becomes inclined at 45° with respect to the upward vertical direction. The direction of turning is reversed again in this state, and the liquid ejection head 50 is turned through 45° in the counter-clockwise direction, then the liquid ejection head 50 returns to the state shown in FIG. 14A. This sequence of turning operations is repeated a prescribed number of times. In other words, the swinging motion is performed by turning the liquid ejection head 50 to a maximum angle of inclination θg (here, 45°) shown in FIG. 14A by observing the normal to the nozzle surface 510.

The maximum angle of inclination θg of the nozzle surface 510 of the liquid ejection head 50 with respect to the direction perpendicular to the conveyance surface 16 is 45° in the above-described case, but the maximum angle of inclination θg is not limited to 45° and may be less than 45°.

Figure 16:
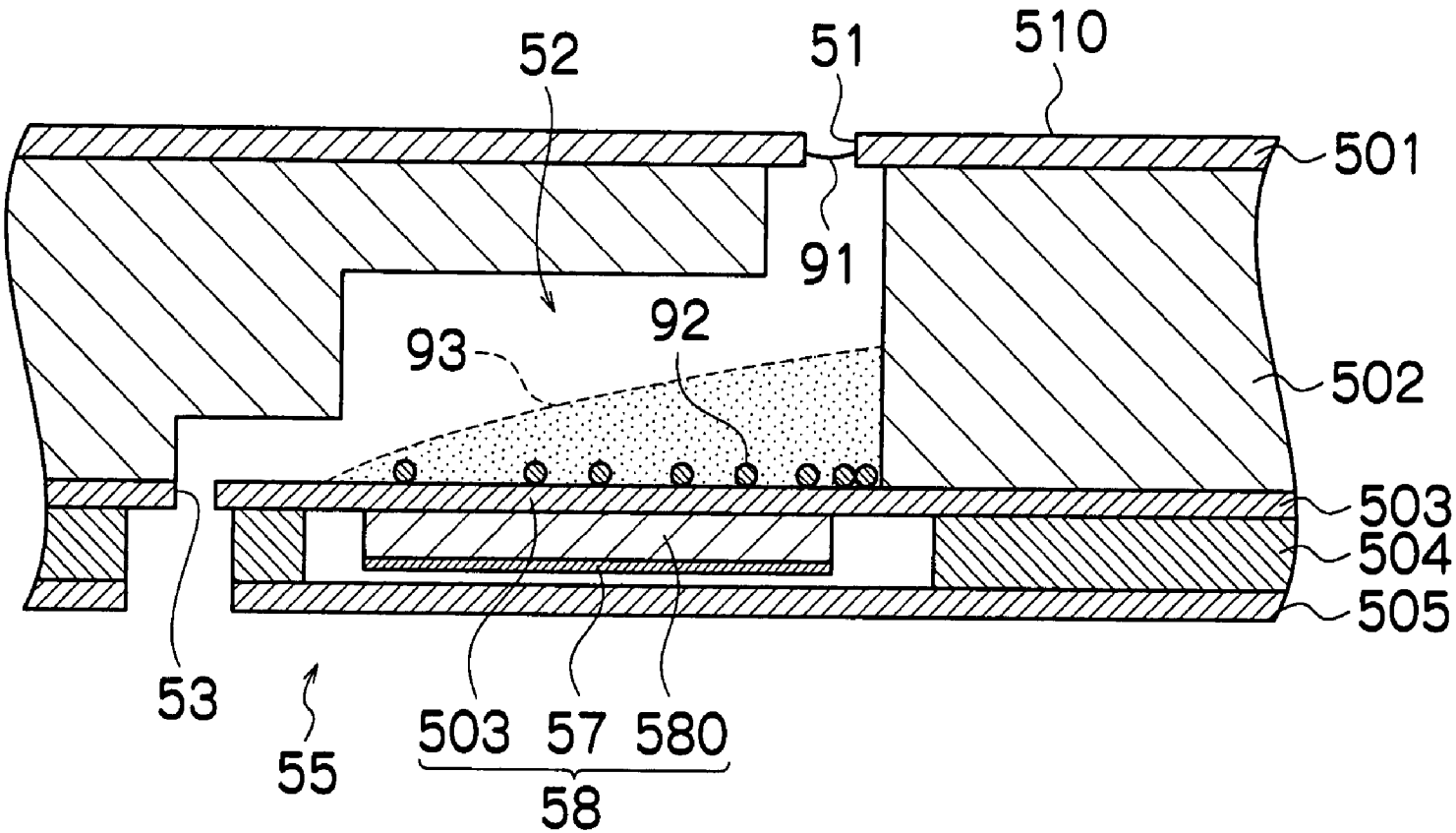
FIG. 16 is a schematic drawing used to describe slight vibration of the diaphragm.

The slight vibration of the diaphragm 503 is carried out under a condition (condition A) where the actuators 58 of the liquid ejection head 50 are applied with the drive voltage that does not cause the liquid to be ejected from the nozzles 51 when the nozzles 51 are in the upward orientated state or the obliquely upward orientated state during the swinging of the liquid ejection head 50 and that has drive frequencies of the slight vibration changing with time from a prescribed low frequency to a prescribed high frequency. In other words, the drive waveform that does not cause the liquid to be ejected from the nozzles 51 at the maximum angle of inclination θg in the swinging motion is applied to the actuators 58, and furthermore, the frequency of the drive waveform (drive frequency) is swept through the prescribed range. By performing the slight vibration of the diaphragm 503 in this way, sediment 92 on the diaphragm 503 shown in FIG. 16 is broken up, and furthermore, the micro-particles in a high-density region 93 in the vicinity of the diaphragm 503 are redispersed.

After performing the swinging motion of the liquid ejection head 50 a prescribed number of times, the slight vibration of the diaphragm 503 is halted (S10).

Thereupon, the liquid ejection head 50 is turned through half a turn by the turning mechanism and set in such a manner that the nozzles 51 are facing vertically downward (S12), whereupon a slight vibration of the diaphragm 503 is started by driving the actuators 58 of the liquid ejection head 50 (S14), and the liquid ejection head 50 is turned by the turning mechanism on the turning axis 40 of the liquid ejection head 50 in the plane perpendicular to the conveyance surface 16, symmetrically on either side of the downward direction perpendicular to the conveyance surface 16 within a prescribed angular range, thereby causing the liquid ejection head 50 to perform a swinging motion (S16).

Figure 15A:
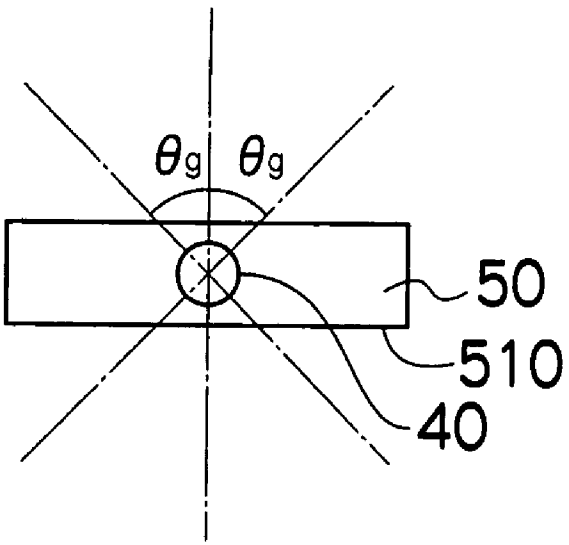
FIGS. 15A to 15C are side view diagrams showing the aspects of a downward-facing swinging motion of the liquid ejection head.
Figure 15B:
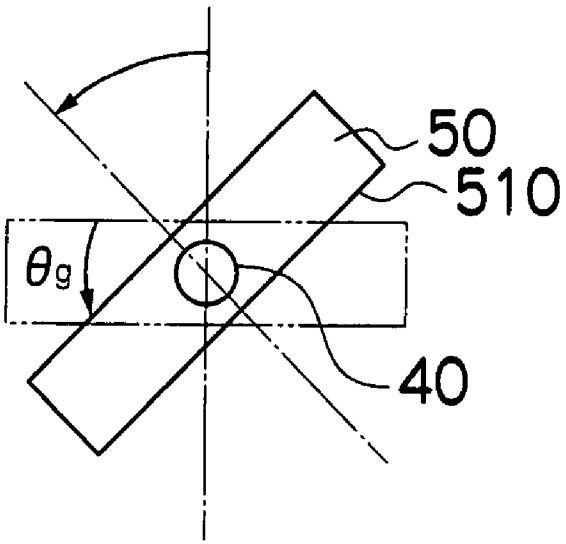
Figure 15C:
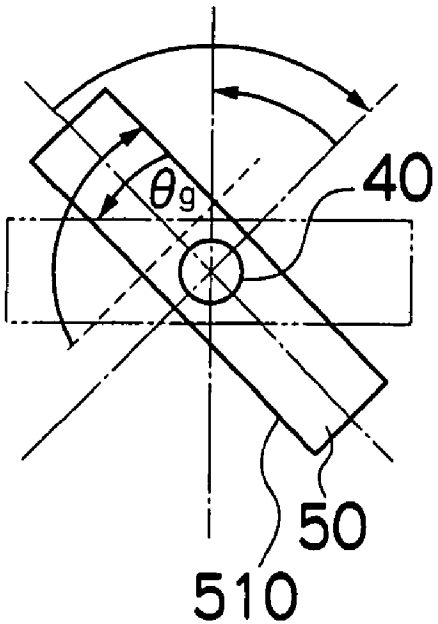

The swinging motion of the liquid ejection head 50 is described below in further detail with reference to FIGS. 15A to 15C. When the liquid ejection head 50 is turned through 45° in the counter-clockwise direction from a state shown in FIG. 15A where the normal to the nozzle surface 510 of the liquid ejection head 50 is orientated in the downward vertical direction, then as shown in FIG. 15B, the normal to the nozzle surface 510 becomes inclined at −45° with respect to the upward vertical direction. The direction of turning is reversed in this state, and the liquid ejection head 50 is turned through 90° in the clockwise direction, then as shown in FIG. 15C, the normal to the nozzle surface 510 of the liquid ejection head 50 becomes inclined at 45° with respect to the downward vertical direction. The direction of turning is reversed again in this state, and the liquid ejection head 50 is turned through 45° in the counter-clockwise direction, then the liquid ejection head 50 returns to the state shown in FIG. 15A. This sequence of turning operations is repeated a prescribed number of times. In other words, the swinging motion is performed by turning the liquid ejection head 50 to a maximum angle of inclination θg (here, 45°) shown in FIG. 15A by observing the normal to the nozzle surface 510.

The slight vibration of the diaphragm 503 is carried out under a condition (condition B) where the actuators 58 of the liquid ejection head 50 are applied with the drive voltage that does not cause the liquid to be ejected from the nozzles 51 when the nozzles 51 are in the downward orientated state or the obliquely downward orientated state during the swinging of the liquid ejection head 50 and that has a constant drive frequency of the slight vibration. In other words, by means of the falling motion of the micro-particles due to gravity, and the slight vibration applied, the liquid is agitated and the micro-particles become further redispersed in the liquid.

After performing the swinging motion of the liquid ejection head 50 a prescribed number of times, the slight vibration of the diaphragm 503 is halted (S18).

Thereupon, the liquid ejection head 50 is moved vertically downward toward the liquid receptacle 64 by means of the vertical movement mechanism, and the liquid ejection head 50 is placed in tight contact with the liquid receptacle 64 (S22).

The positions of the free surfaces of the liquid in the nozzles 51 of the liquid ejection head 50 are adjusted in accordance with the vertical movement distance of the liquid ejection head 50 (S4). If there is no change in the positions of the free surfaces of the liquid in the nozzles 51 due to the vertical movement of the liquid ejection head 50, then this adjustment is not necessary.

In the state in which the nozzles 51 of the liquid ejection head 50 are facing downward and the liquid ejection head 50 is tightly in contact with the liquid receptacle 64, suctioning by means of the liquid suction pump 67 (S26), purging by driving the actuators 58 of the liquid ejection head 50 (S28), and wiping of the nozzle surface 50 using the wiper 66 (S30) are carried out, and it is then judged whether this sequence of maintenance operations (S26, S28, S30) has been completed a prescribed number of times (S32).

After carrying out the sequence of maintenance operations (S26, S28, S30) the prescribed number of times, the liquid receptacle 64 is retracted (S34), and the liquid ejection head 50 is moved vertically by means of the vertical movement mechanism, in such a manner that a prescribed clearance is formed between the nozzle surface 510 of the liquid ejection head 50 and the conveyance surface 16 (S36).

After completing the above-described operations (S2 to S36), the recording medium 116 is conveyed, and an image is formed on the recording medium 116 by ejecting ink toward the recording medium 116 from the nozzles 51 of the liquid ejection head 50, on the basis of image data.

Figure 12:
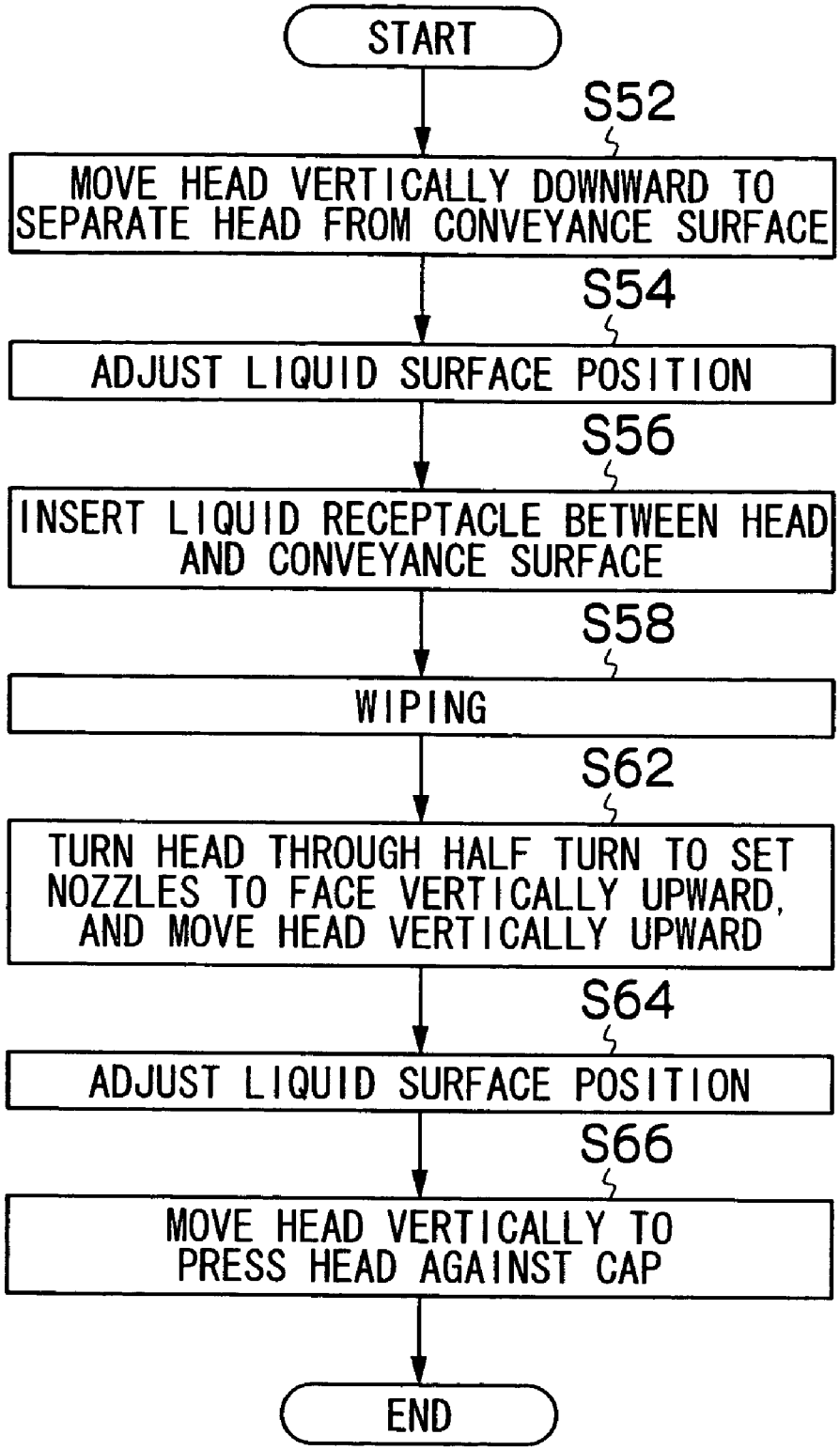
FIG. 12 is a flowchart showing a maintenance sequence that is carried out after image formation in the image forming apparatus.

FIG. 12 is a flowchart showing an embodiment of a maintenance sequence that is carried out after the image formation.

Prior to the maintenance sequence shown in FIG. 12, in the image forming apparatus 110, the nozzles 51 of the liquid ejection head 50 are positioned facing vertically downward, and the liquid receptacle 64 is set in the retracted position.

Firstly, the liquid ejection head 50 is separated from the conveyance surface 16 by moving the liquid ejection head 50 vertically upward by means of the vertical movement mechanism (S52).

Then, the positions of the free surfaces of the liquid in the nozzles 51 of the liquid ejection head 50 are adjusted in accordance with the vertical movement distance of the liquid ejection head 50 (S54). If there is no change in the positions of the free surfaces of the liquid in the nozzles 51 due to the vertical movement of the liquid ejection head 50, then this adjustment is not necessary. The adjustment of the positions of the free surfaces of the liquid in the nozzles 51 is described in detail hereinafter.

Thereupon, the liquid receptacle 64 is introduced between the liquid ejection head 50 and the conveyance surface 16 (S56), and the nozzle surface 510 of the liquid ejection head 50 is wiped by means of the wiper 66 (S58).

Then, the liquid ejection head 50 is turned through a half turn by the turning mechanism, thereby setting the nozzles 51 to face in the upward vertical direction, and the liquid ejection head 50 is then moved vertically upward by the vertical movement mechanism (S62).

The positions of the free surfaces of the liquid in the nozzles 51 of the liquid ejection head 50 are then adjusted in accordance with the vertical movement distance of the liquid ejection head 50 (S64). More specifically, the adjustment is performed so that the free surface 91 of the liquid is positioned inside the nozzle 51 as shown in FIG. 16. If there is no change in the positions of the free surfaces of the liquid in the nozzles 51 due to the vertical movement of the liquid ejection head 50, then this adjustment is not necessary.

Thereupon, the liquid ejection head 50 is pressed against the cap 63 by means of the vertical movement mechanism, and the nozzles 51 of the liquid ejection head 50 are sealed by the cap 63 (S66).

In this way, the nozzle surface 510 of the liquid ejection head 50 is set to face upward and is sealed by the cap 63. Hence, even if aggregation and settling of the micro-particles in the liquid occur, it merely results in the sediment 92 settling on the diaphragm 503 and/or the high-density region 93 arising in the vicinity of the diaphragm 503, as shown in FIG. 16. Consequently, it is possible to prevent blockage of the nozzle 51, which is liable to occur in the related art due to the sediment settling toward the free surface 91 of the liquid in the nozzle 51.

Figure 13:
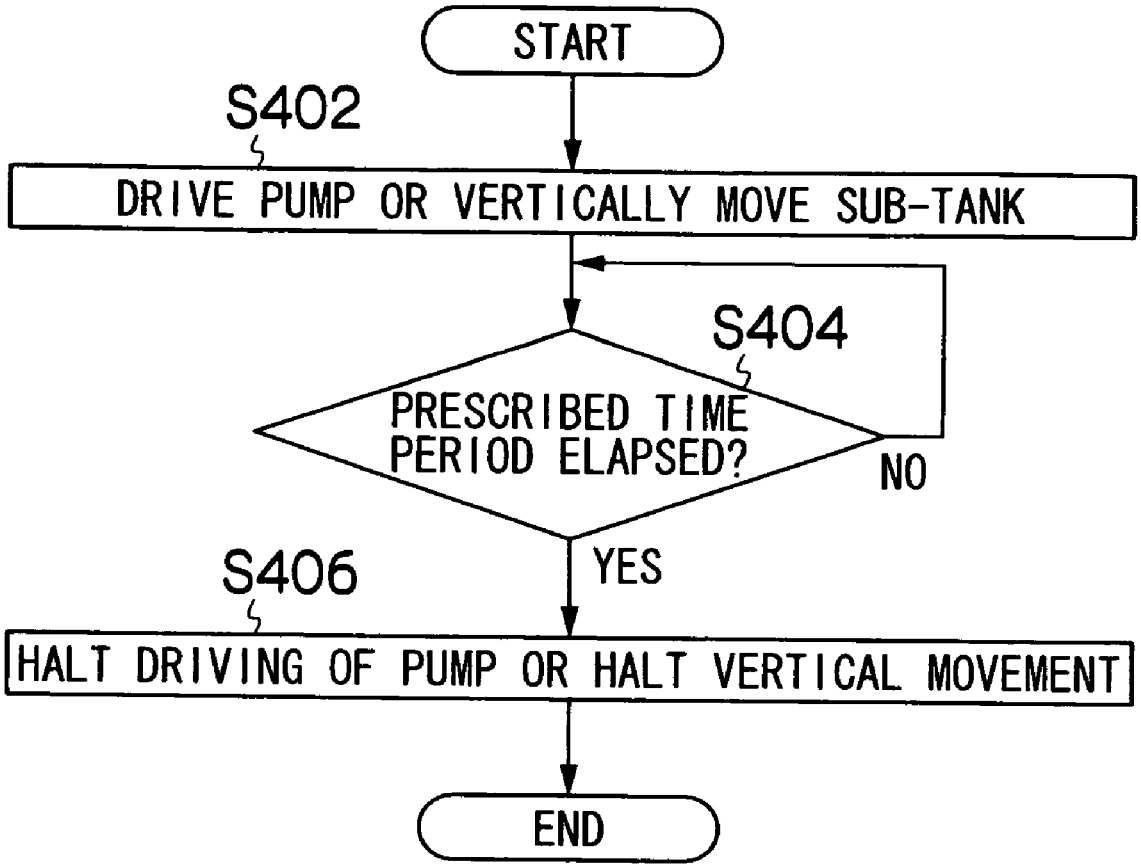
FIG. 13 is a flowchart showing the details of adjustment of a position of a free surface of the liquid.

FIG. 13 is a flowchart showing the details of the position adjustment operation for the free surfaces of the liquid in the nozzles 51 using the vertical movement of the liquid ejection head 50 (steps S4 and S24 in FIG. 11, and steps S54 and S64 in FIG. 12).

The position of the free surface of the liquid (the liquid-atmosphere interface, which is also commonly called "meniscus") in the liquid ejection head 50 is governed by the internal pressure of the liquid ejection head 50. The internal pressure of the liquid ejection head 50 is adjusted by varying the height differential between the free surface of the liquid in the sub-tank 61 shown in FIG. 7 and the nozzle surface 510 of the liquid ejection head 50. In general, apart from during liquid ejection, the internal pressure of the liquid ejection head 50 is set to a pressure slightly lower than the atmospheric pressure (this lower pressure is commonly called the "negative pressure").

In the composition where the liquid supply pump 62 is provided between the main tank 60 and the sub-tank 61 as shown in FIG. 7, desirably, the position of the free surface of the liquid is adjusted finely by using the liquid supply pump 62. It is also possible to adjust the positions of the free surfaces of the liquid in the nozzles 51 by vertically moving the sub-tank 61.

The positions of the free surfaces of the liquid in the nozzles 51 are adjusted by driving the liquid supply pump 62 (or vertically moving the sub-tank 61), only in cases where the positions of the free surfaces of the liquid in the nozzles 51 change due to the variation of the internal pressure caused by the change of the height differential between the nozzle surface 510 of the liquid ejection head 50 and the free surface of the liquid in the sub-tank 61 according to the distance of vertical movement of the liquid ejection head 50 (S402). Time is measured by a timer (not shown), and it is judged whether or not a prescribed time period has elapsed (S404). If the prescribed time period has elapsed, then the driving of the liquid supply pump 62 (or the vertical movement of the sub-tank 61) is halted.

The liquid maintenance operations described above with reference to FIGS. 11, 12 and 13 are carried out under the control of the head controller 250 shown in FIG. 8, in accordance with a program.

The slight vibration of the diaphragm 503 is carried out during the swinging of the liquid ejection head 50 in the above-described embodiments, and moreover, during a long period without performing printing, it is also preferable to carry out the slight vibration of the diaphragm 503 on the basis of time management, under the condition (the condition A) where the drive frequency is swept through a range as described above, without implementing a swinging motion of the liquid ejection head 50 by driving turning, and while the liquid ejection head 50 remains sealed by the cap 63.

The common liquid chamber 55 is situated on the opposite side of the actuators 58 from the pressure chambers 52 in the above-described embodiments as shown in FIGS. 1 to 4, but the present invention may also be applied to a composition where the common liquid chamber is situated on the same side of the actuators as the pressure chambers, as long as the direction of liquid ejection is a downward direction.

The liquid ejected from the liquid ejection head 50 is ink in the above-described embodiments, but the present invention may also be applied to a conductive liquid ejected toward a substrate when forming conductive wires on the substrate, or a liquid ejected toward an optical material during manufacture of a color filter, or the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

an ejection receiving medium conveyance device which has a conveyance face and conveys an ejection receiving medium placed on the conveyance face;

a liquid ejection head of a full-line type which has nozzles ejecting liquid in a downward-facing state and pressure chambers connected to the nozzles, the nozzles ejecting the liquid toward the ejection receiving medium on the conveyance face, the nozzles being arranged on the liquid ejection head through a length corresponding to a width of the ejection receiving medium;

a perpendicular movement device which moves the liquid ejection head in a direction perpendicular to the conveyance face;

a turning device which turns the liquid ejection head to switch the nozzles of the liquid ejection head between the downward-facing state and an upward-facing state; and a sealing device which seals the nozzles when the nozzles of the liquid ejection head are in the upward-facing state, wherein the turning device performs a plurality of swinging operations consecutively to make the liquid ejection head swing to agitate the liquid inside the liquid ejection head, the liquid ejection head being inclined from side to side by a predetermined angle around the upward-facing state in each of the swinging operations.

2. The liquid ejection apparatus as defined in claim 1, further comprising a vibrating device which vibrates the liquid in the pressure chambers slightly to an extent which does not cause the liquid to be ejected from the nozzles, during the turning device performing the swinging operations.

3. The liquid ejection apparatus as defined in claim 1, further comprising a liquid receptacle device which moves along the conveyance face to a position between the liquid ejection head and the conveyance face at which the liquid receptacle device receives the liquid ejected by dummy ejection from the nozzles.

4. The liquid ejection apparatus as defined in claim 1, further comprising a liquid receptacle device which moves along the conveyance face to a position between the liquid ejection head and the conveyance face at which the liquid receptacle device receives the liquid suctioned from the nozzles.

5. A liquid maintenance method for maintaining a state of liquid inside a liquid ejection head of a fill-line type which has nozzles ejecting the liquid and pressure chambers connected to the nozzles, the nozzles ejecting the liquid toward an ejection receiving medium placed and conveyed on a conveyance face, the nozzles being arranged on the liquid ejection head through a length corresponding to a width of the ejection receiving medium, the method comprising the steps of:

moving the liquid ejection head in a direction perpendicular to the conveyance face; and agitating the liquid inside the liquid ejection head by performing a plurality of swinging operations consecutively to make the liquid ejection head swing by turning the liquid ejection head, the liquid ejection head being inclined from side to side by a predetermined angle around an upward-facing state in each of the swinging operations.

6. The liquid maintenance method as defined in claim 5, wherein the agitating step includes the step of vibrating the liquid inside the pressure chambers slightly to an extent which does not cause the liquid to be ejected from the nozzles, during performing the swinging operations.

7. The liquid maintenance method as defined in claim 6, wherein in the vibrating step, a drive frequency to vibrate the liquid inside the pressure chambers is swept.

8. The liquid maintenance method as defined in claim 5, wherein the moving step includes the step of adjusting positions of free surfaces of the liquid in the nozzles in accordance with a distance of movement of the liquid ejection head.

9. The liquid maintenance method as defined in claim 5, further comprising the step of performing a plurality of downward swinging operations consecutively to make the liquid ejection head swing by turning the liquid ejection head, the liquid ejection head being inclined from side to side by a predetermined angle around a downward-facing state in each of the downward swinging operations.

* * * * *